US006099181A

United States Patent [19]

Kitabatake

[11] Patent Number: 6,099,181

[45] Date of Patent: Aug. 8, 2000

[54] PRINTING CONTROL APPARATUS, PRINTING METHOD WITH THE PRINTING CONTROL APPARATUS, AND STORAGE MEDIUM STORING A COMPUTER READABLE PROGRAM

[75] Inventor: Hironobu Kitabatake, Tokyo, Japan

[73] Assignee: Canon Kabushiki Kaisha, Tokyo, Japan

[21] Appl. No.: 09/290,267

[22] Filed: Apr. 13, 1999

[30] Foreign Application Priority Data

Apr. 14, 1998 [JP] Japan ..... 10-103090

[51] Int. Cl.[7] ..... B41J 11/62

[52] U.S. Cl. ..... 400/710; 400/76; 400/70; 400/61

[58] Field of Search ..... 400/279, 76, 70, 400/61, 63, 710; 347/16

[56] References Cited

U.S. PATENT DOCUMENTS 4,617,580 10/1986 Miyakawa ..... 346/136
5,619,240 4/1997 Pong et al. ..... 347/103
5,714,990 2/1998 Courtney ..... 347/14
5,801,722 9/1998 Ueda et al. ..... 347/16

*Primary Examiner*—John S. Hilten
*Assistant Examiner*—Charles H. Nolan, Jr.
*Attorney, Agent, or Firm*—Fitzpatrick, Cella, Harper & Scinto

[57] ABSTRACT

Disclosed is a printing control apparatus for controlling a printing process performed on recording media according to printing information input from a data processing apparatus via a particular communication medium, the recording media being fed one by one to a printing mechanism and ejected out of the main part of a printer. The apparatus has a variably setting unit for variably setting the resolution of the printing mechanism; a calculator for calculating the time required for the printing process on a recording medium until ejecting the recording medium out of the main part of the printer, depending on the resolution variably set by the variably setting unit; a time measurement mechanism for measuring an elapsed time; and a judgment unit for judging whether a recording medium has been ejected on the basis of the elapsed time measured by the time measurement mechanism and also on the basis of the time calculated by the calculator.

55 Claims, 15 Drawing Sheets

FIG. 4

| RESOLUTION (DPI) | T1 (SEC) |
|---|---|
| 600 | t51 |
| 1200 | t52 |

FIG. 5

| PAPER SIZE | T2 FOR 600 DPI (SEC) | T2 FOR 1200 DPI (SEC) |
|---|---|---|
| A3 | t61 | t62 |
| B4 | t63 | t64 |
| A4 | t65 | t66 |
| B5 | t67 | t68 |

FIG. 7

| PAGE | 1 | 2 | 3 | 4 | 5 |
|---|---|---|---|---|---|
| PROCESSING STATUS | SAFE | SAFE | TOP | PRINT | WAIT |

FIG. 8

| PAGE | 1 | 2 | 3 | 4 | 5 |
|---|---|---|---|---|---|
| PROCESSING STATUS | SAFE | SAFE | WAIT | WAIT | WAIT |

FIG. 15

| PAPER TYPE | T1 (SEC) |
|---|---|
| PLAIN PAPER | t121 |
| OHT PAPER | t122 |
| THICK PAPER | t123 |

FIG. 16

| PAPER SIZE | T2 (PLAIN PAPER) | T2 (OHT PAPER) | T2 (THICK PAPER) |
|---|---|---|---|
| A3 | t131 SEC | t132 SEC | t133 SEC |
| B4 | t134 SEC | t135 SEC | t136 SEC |
| A4 | t137 SEC | t138 SEC | t139 SEC |
| B5 | t1310 SEC | t1311 SEC | t1312 SEC |

FIG. 18

| PAGE | 1 | 2 | 3 | 4 | 5 | 6 |
|---|---|---|---|---|---|---|
| PROCESSING STATUS | SAFE | SAFE | TOP | PRINT | WAIT | WAIT |

FIG. 19

| PAGE | 1 | 2 | 3 | 4 | 5 | 6 |
|---|---|---|---|---|---|---|
| PROCESSING STATUS | SAFE | SAFE | WAIT | WAIT | WAIT | WAIT |

FIG. 23

STORAGE MEDIUM SUCH AS A FD OR CD-ROM

| DIRECTORY INFORMATION |
| --- |
| FIRST DATA PROCESSING PROGRAM<br>A SET OF PROGRAM CODES CORRESPONDING TO THE STEPS SHOWN INF THE FLOWCHART SHOWN IN FIG. 6 |
| SECOND DATA PROCESSING PROGRAM<br>A SET OF PROGRAM CODES CORRESPONDING TO THE STEPS SHOWN INF THE FLOWCHART SHOWN IN FIG. 9 |
| THIRD DATA PROCESSING PROGRAM<br>A SET OF PROGRAM CODES CORRESPONDING TO THE STEPS SHOWN INF THE FLOWCHART SHOWN IN FIG. 10 |
| FOURTH DATA PROCESSING PROGRAM<br>A SET OF PROGRAM CODES CORRESPONDING TO THE STEPS SHOWN INF THE FLOWCHART SHOWN IN FIG. 17 |
| FIFTH DATA PROCESSING PROGRAM<br>A SET OF PROGRAM CODES CORRESPONDING TO THE STEPS SHOWN INF THE FLOWCHART SHOWN IN FIG. 20 |
| SIXTH DATA PROCESSING PROGRAM<br>A SET OF PROGRAM CODES CORRESPONDING TO THE STEPS SHOWN INF THE FLOWCHART SHOWN IN FIG. 21 |
| |

MEMORY MAP OF A STORAGE MEDIUM

PRINTING CONTROL APPARATUS, PRINTING METHOD WITH THE PRINTING CONTROL APPARATUS, AND STORAGE MEDIUM STORING A COMPUTER READABLE PROGRAM

BACKGROUND OF THE INVENTION

1. Field of the Invention

The present invention relates to a printing control apparatus for controlling a printing process on recording media according to printing information input from a data processing apparatus received via a particular communication medium wherein the recording media are fed one by one to a printing mechanism and ejected out of the main part of a printer. The invention also relates to a printing method with the printing control apparatus and to a storage medium on which a computer readable program is stored.

2. Description of the Related Art

With rapid advances in office automation, it becomes necessary to transfer an increasingly large amount of data from a host computer to a printer so as to perform a greater number of printing jobs.

In an increasingly large number of cases, a single printer is used in a plurality of different manners as required. For example, when a draft document is printed or when test printing is performed, a low resolution is employed. On the other hand, a high resolution is employed for a document to be used in a meeting or for a document including a high-definition image. Plain paper is used for an ordinary document whereas OHT paper is employed when a document for a meeting is printed. In some cases, printing is performed on thick paper such as an envelope. Special types of paper such as high gloss paper are also used.

One technique to deal with various resolutions and various types of paper is to change the feeding speed for paper passing through various printing mechanisms in a printer such as a laser beam printer, depending on the purpose. More specifically, when high resolution is required, the speed of transferring a toner image to paper is changed. To deal with various types of paper, the heating time in the fixing process may be changed to fuse toner to a higher degree.

However, in conventional printers, the time from the start of a printing operation to ejection of paper output of the printer is determined only by the paper transport distance and the size of paper. Therefore, in printers of the type in which the resolution is varied by varying the paper transport speed, it is impossible to calculate the paper ejection time. This can cause a problem such that when a jam occurs a particular page is skipped without being printed or a particular page is printed a plurality of times. A similar problem can also occur in a printer of the type in which the paper feeding speed is varied depending on the type of paper.

Some printers include a sensor disposed near a paper ejection slot so that ejection of paper is detected by the sensor. However, in this type of printer, it is required to vary the intervals or the timing of paper ejection detection, depending on the paper feeding speed. This requires a complicated mechanism and complicated control.

SUMMARY OF THE INVENTION

It is a general object of the present invention to solve the problems described above. More specifically, it is an object of the present invention to provide a technique of precisely determining when a recording medium is ejected out of a printer regardless of the resolution of a printing mechanism.

It is another object of the present invention to provide a technique of precisely controlling the process which may vary page by page, thereby ensuring that even if jamming occurs during the process of transporting a recording medium in the environment where the resolution of the printing mechanism is variable, the status of the process for each page can be precisely determined thereby making it possible to properly restart the process for each page after recovery from the jam, thus preventing an already-printed page from being printed on again and preventing a not-yet-printed page from being skipped without being printed.

It is another object of the present invention to provide a technique of precisely determining when a recording medium is ejected out of a printer regardless of the type of the recording medium fed to the printing mechanism. It is still another object of the present invention to provide a technique of precisely controlling the process which may vary page by page thereby ensuring that even if jamming occurs during the process of transporting a recording medium in the environment where two or more different types of recording media may be used, the status of the process for each page can be precisely determined and, therefore, it is possible to properly restart the process for each page after recovery from the jam, thus preventing an already-printed page from being printed on again and preventing a not-yet-printed page from being skipped without being printed. These and other objects and features of the present invention will be more apparent from the following detailed description of the invention, taken together with the accompanying drawings and appended claims.

In accordance with these objects, there is provided a printing control apparatus for controlling a printing process according to print information input from a data processing apparatus, the printing control apparatus comprising variably setting means for variably setting a resolution of a printing mechanism, obtaining means for obtaining a time required from receipt of a print signal until ejecting a recording medium out of the printer, on the basis of the resolution variably set by the variably setting means, time measurement means for measuring an elapsed time and judgment means for judging whether a recording medium has been ejected, on the basis of the elapsed time measured by the time measurement means and the obtained time obtained by the obtaining means.

In accordance with another aspect of the present invention, there is provided a printing control apparatus for controlling a printing process according to printing information input from a data processing apparatus, the printing control apparatus comprising setting means for setting a type of recording medium to be subjected to a printing operation, obtaining means for obtaining a time required from receipt of a print signal until ejecting the recording medium out of the printer, on the basis of the type of recording medium set by the setting means, time measurement means for measuring an elapsed time and judgment means for judging whether a recording medium has been ejected, on the basis of the elapsed time measured by the time measurement means and the obtained time obtained by the obtaining means.

In accordance with yet another aspect of the present invention there is provided for printing methods corresponding to each of the above-defined apparatus, and there is further provided a storage medium on which computer readable programs are stored for carrying out these processes.

BRIEF DESCRIPTION OF THE DRAWINGS

FIG. 4 is a table illustrating the correspondence between the normal time period T1 shown in FIG. 3 and the resolution;

FIG. 5 is a table illustrating the correspondence between the normal time period T2 shown in FIG. 3 and the resolution or the paper size;

FIG. 7 illustrates an example of a page processing status table managed by the printer controller shown in FIG. 1;

FIG. 8 illustrates another example of the page processing status table managed by the printer controller shown in FIG. 1;

FIG. 15 is a table illustrating the correspondence between the normal time period Ti shown in FIG. 14 and the paper type;

FIG. 16 is a table illustrating the correspondence between the normal time period T2 shown in FIG. 14 and the type or size of paper;

FIG. 18 is an example of a page processing status table managed by the printer controller shown in FIG. 12;

FIG. 19 is another example of the page processing status table managed by the printer controller shown in FIG. 12;

FIG. 23 is a schematic representation of a memory map of a storage medium for storing various data processing programs readable by the printing system including the printing control apparatus according to the present invention.

DESCRIPTION OF THE PREFERRED EMBODIMENT

An example of the construction of a laser beam printer which is an example of an output device according to an embodiment of the present invention is first described below.

First Embodiment

Figure 1:
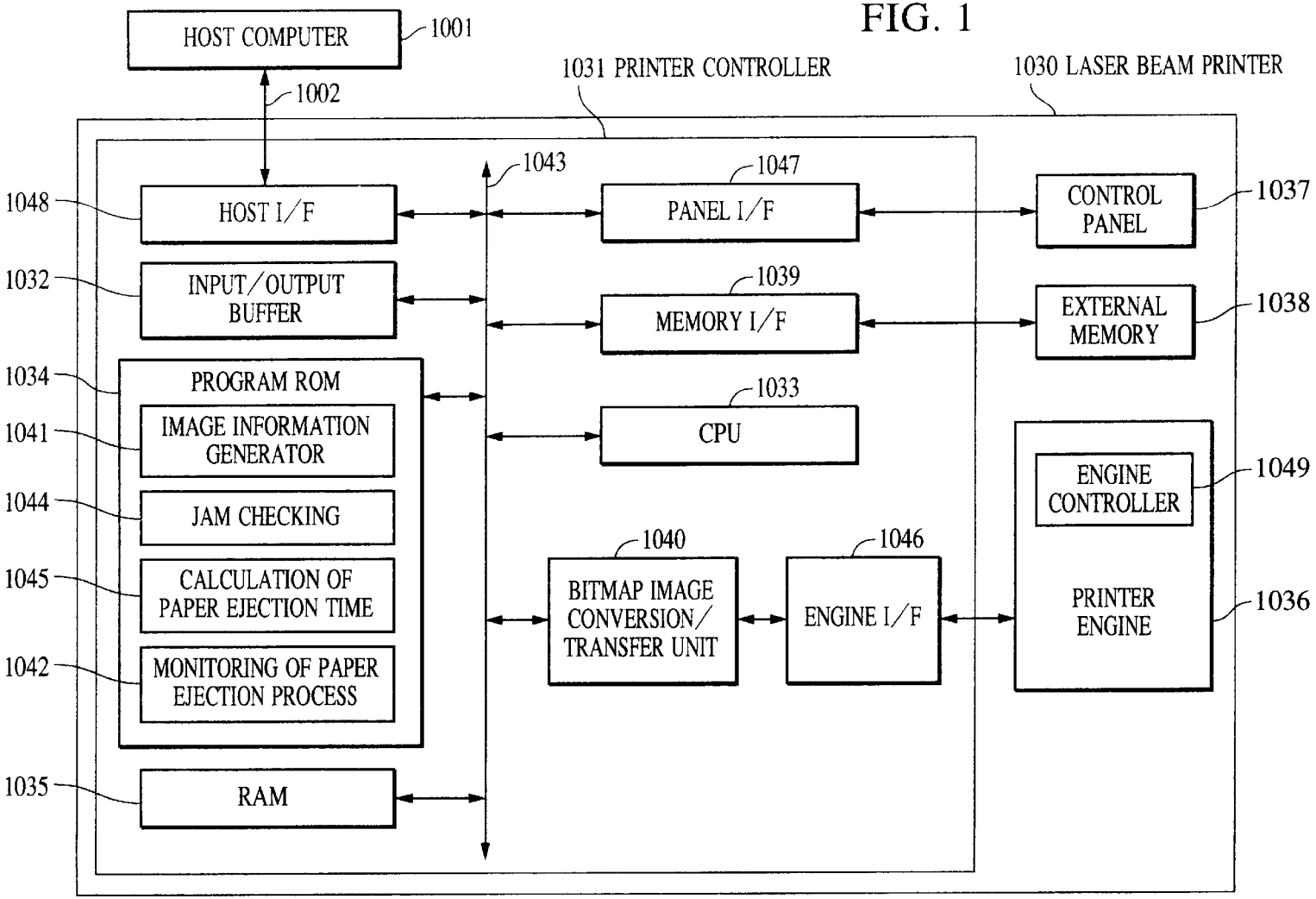
FIG. 1 is a block diagram illustrating a printing system including a printing control apparatus according to a first embodiment of the invention.

FIG. 1 is a block diagram illustrating a printing system including a printing control apparatus according to a first embodiment of the invention. In this specific embodiment, the printing system includes a host computer 1001, a laser beam printer 1030, and a communication line 1002 through which the host computer 1001 and the laser beam printer 1030 are connected to each other.

In the laser beam printer 1030, a printer controller (control unit) 1031 is responsible for controlling the operation over the entire printer. A host I/F 1048 serves to input and output data from and to the host computer 1001.

An input/output buffer 1032 serves to transmit and receive control codes and data to and from various communication means. A CPU 1033 serves to control the operation of the entire control unit 1031. A program ROM 1034 stores a program describing the operation of the CPU 1033.

A RAM 1035 is used as a work memory for interpreting the above-described control codes and other data, for calculations required in the printing process, and for processing printing data. An image information generator 1041 generates various image objects according to the setting associated with data received from the host computer.

A bitmap image conversion/transfer unit 1040 converts an image object to a bitmap image and transfers the resultant bitmap image to a printer engine. The printer engine 1036 performs printing on paper according to a command from an engine controller 1049.

An engine interface (engine I/F) 1046 is an interface via which communication is performed between the printer engine 1036 and the control unit 1031.

In the program ROM 1034, a paper ejection time calculation unit 1045 calculates the printing time until completely ejecting a sheet of paper. A jam checking unit 1044 checks whether paper is successfully ejected. A paper ejection controller 1042 performs scheduling on pages to be printed. If a jam occurs, the paper ejection controller 1042 performs rescheduling on pages which are not yet completed.

A control panel unit 1037 includes keys used to control the operation of the printer and also includes an LCD panel and LEDs. Information input via a panel interface (panel I/F) 1047 in the control unit 1031 is displayed on the control panel unit 1037. Key information input via the control panel unit 1037 is output to the control unit 1031.

An external memory 1038 is used to store printing data and other information associated with the printer. The control unit 1031 accesses the external memory 1038 via a memory interface (memory I/F) 1039.

A system bus 1043 is a bus used by the CPU 1033 to access various units.

Figure 2:
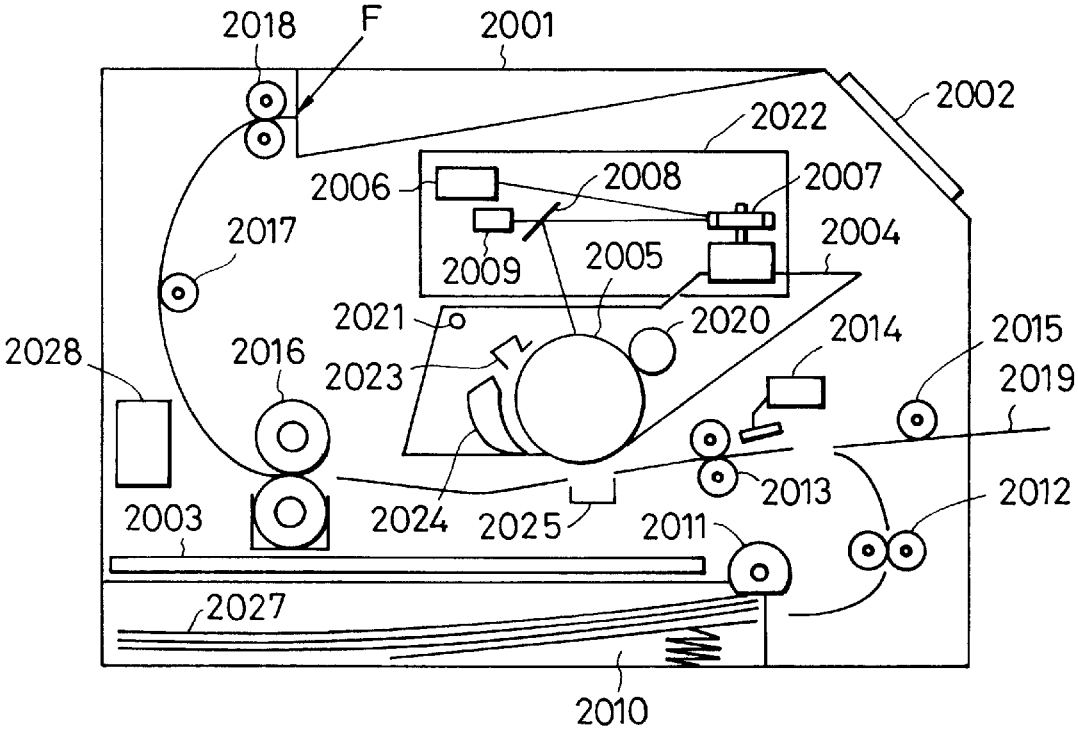
FIG. 2 is a cross-sectional view illustrating an example of the construction of the printer engine shown in FIG. 1.

FIG. 2 is a cross-sectional view illustrating an example of the construction of the printer engine 1036 shown in FIG. 1, wherein in this specific example, a laser beam printer engine is employed as the printer engine.

In an enclosure 2001, as shown in FIG. 2, there are provided a printer engine (engine) 1036 including various mechanisms, an engine controller 1049 for controlling printing processes (such as a paper feeding process) performed by the various mechanisms, and a control board 2003 including the printer controller 1031 (shown in FIG. 1).

The mechanisms of the engine 1036 include an optical processing mechanism for forming an electrostatic latent image on a photosensitive drum by scanning a laser beam, converting the electrostatic latent image into a visible image, and then transferring the visible image onto printing paper;

a fixing mechanism for fixing the toner image transferred to the printing paper; a paper feeding mechanism for feeding printing paper; and a paper transporting mechanism for transporting printing paper.

The optical processing mechanism includes a laser driver 2006 provided in a laser scanner 2022. The laser driver 2006 turns on and off a semiconductor laser (not shown) so that a laser beam is emitted from the semiconductor laser in response to the image data supplied from the printer controller 1031. The laser beam emitted from the semiconductor laser is deflected in the scanning direction by a rotating polygon mirror 2007.

The laser beam deflected in the main scanning direction is reflected by a reflecting mirror 2008 onto the photosensitive drum 2005 so that the photosensitive drum 2005 is exposed to light in the main scanning direction.

When the photosensitive drum 2005, which has been uniformly charged in advance by a primary charger 2023, is exposed to the laser beam, a latent image is formed on the photosensitive drum 2005. Then toner (black toner is employed in this embodiment) is applied from a developing unit 2020 to the photosensitive drum 2005 so that the latent image is converted to a visible image. The toner image on the photosensitive drum 2005 is transferred by a transfer charger 2025 onto printing paper 2027 synchronously fed in a secondary scanning direction by the paper feeding mechanism.

The photosensitive drum 2005 and the developing unit 2020 are disposed in a cartridge which may be removed from the enclosure 2001 (in this embodiment, monocolor printing may be performed by mounting a cartridge including a developer with a desired color).

The reflecting mirror 2008 is made up of a half mirror. A beam detector 2009 is disposed at the back of the reflecting mirror 2008 so that the laser beam is detected by the beam detector 2009 and the resultant detected signal is supplied to the printer controller 1031. In accordance with the detected signal supplied from the beam detector 2009, the printer controller 1031 generates a horizontal synchronizing signal serving to determine the exposure timing.

A cleaner 2024 removes toner remaining on the photosensitive drum 2005. A pre-exposing lamp 2021 removes charges remaining on the photosensitive drum 2005 by illuminating it with light.

The fixing mechanism includes a fixing unit 2016 for using the toner image transferred to the printing paper by means of heat and pressure. The fixing unit 2016 includes a heater for heating the toner image. The heater is controlled in accordance with a signal from the engine controller 1049 so that the fixing temperature is maintained at a proper value (whereas the power is saved during a print waiting state).

The paper feeding mechanism includes a cassette 2010 for storing printing paper 2027 and also includes a manual feeding tray 2019. The paper feeding mechanism is adapted to selectively feed printing paper either from the cassette 2010 or the manual feeding tray 2019.

The cassette 2010 includes a size detection mechanism for electrically detecting the size of printing paper by detecting the position of a partition plate (not shown). Printing paper at the top of the stack of paper stored in the cassette 2010 is fed to a paper feeding roller 2012 by rotating a cassette paper feeding clutch 2011, wherein one sheet of printing paper is fed at a time. The cassette paper feeding clutch 2011 includes a cam which is intermittently rotated by driving means (not shown) for each sheet. That is, one sheet of printing paper is fed each time the cam rotates.

The paper feeding roller 2012 feeds the printing paper until the leading end of the printing paper comes to a location corresponding to a registration shutter 2014. The registration shutter 2014 disables and enables the feeding of the printing paper by applying and releasing pressure to the printing paper. The operation of the registration shutter 2014 is controlled by the engine controller 1049 in synchronization with the secondary scanning of the laser beam. A desired number of option cassettes (not shown) for storing various sizes of paper may be placed above the cassette 2010.

The manual feeding tray 2019 is disposed on the enclosure 2001. If a user puts printing paper on the tray 2019, it is fed to the registration shutter 2014 via a paper feeding roller 2015.

In this specific embodiment, the laser beam printer is capable of switching the resolution between two values, 600 DPI and 1200 DPI.

More specifically, when the resolution is switched from 600 DPI to 1200 DPI, the number of dots per line is doubled without changing the main scanning speed per line whereas the printing speed in the secondary scanning direction is reduced to one half the speed employed for 600 DPI thereby increasing the dot density in the secondary scanning direction by a factor of two.

Furthermore, the resolution may be specified by a user to a desired value by directly inputting data into the host computer or by inputting data via the control panel unit 1037.

The paper transporting mechanism for transporting printing paper includes a paper transporting roller 2013 which transports printing paper to the photosensitive drum 2005 when the pressure applied by the registration shutter 2014 to the printing paper is released, paper transporting rollers 2017 and 2018 for transporting the printing paper from the fixing unit 2016 to a printed paper tray disposed on the top of the enclosure 2001, driving means (not shown) for driving the paper transport rollers 2013, 2017, and 2018.

On the enclosure 2001, there is provided a control panel 2002 serving as the control panel unit 1037 shown in FIG. 1.

The control panel 2002 includes switches for inputting commands, LEDs for displaying information, and an LCD device. Furthermore, there is provided an external memory unit 2028 serving as the external memory 1038 used by the printer controller to store printing data and other data.

The operation of the printer controller in the above system is described below.

If the user issues a print start command via the host computer 1001, control codes and data are transmitted from the host computer 1001 via the communication line 1002. The control codes and data received via the host I/F 1048 are stored in the RAM 1035 via the input/output buffer 1032.

In accordance with the program described in the program ROM 1034, the CPU 1033 processes data via the image information generator 1041 so as to generate image information such as graphics, characters, and image data (image objects) one by one.

After completion of generating all image objects included in one page, the bitmap image conversion/transfer unit 1040 converts the image information into the form of bit map image data and transmits the resultant bit map image data to the printer engine 1036. The printer engine 1036 prints an image on paper in accordance with the bit map image data. The printed paper is ejected face down to the outside via the paper ejection slot F shown in FIG. 2.

The operation of the paper ejection controller 1042 is described below for each processing step with reference to FIGS. 3 and 4.

Figure 3:
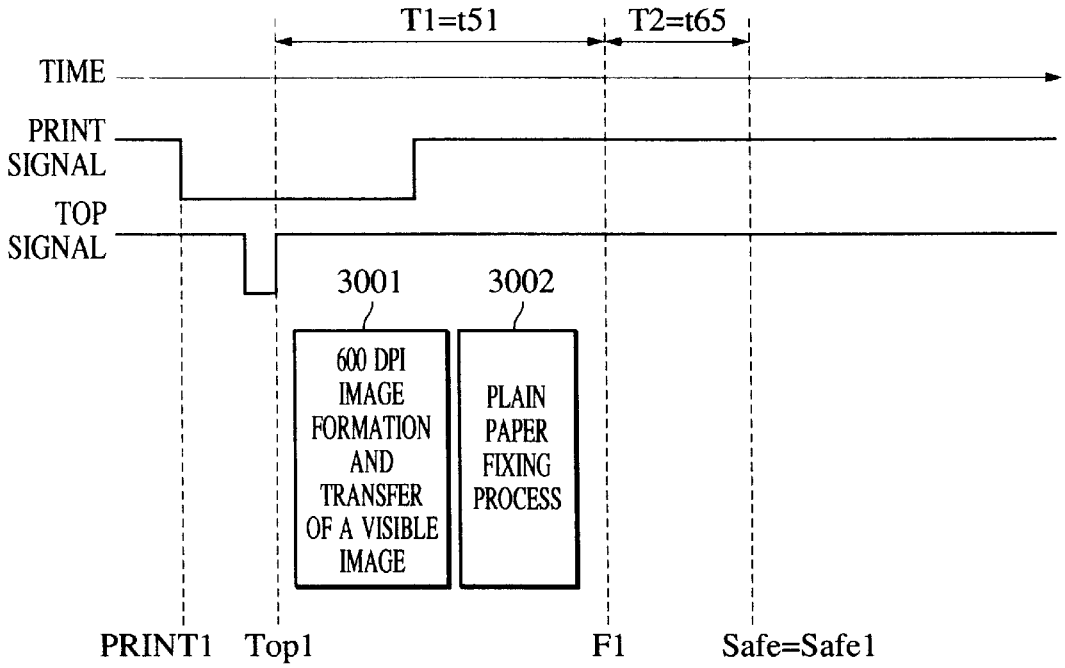
FIG. 3 is a first timing chart illustrating the operations of the printer controller and the printer engine shown in FIG. 1.

FIG. 3 is a first timing chart illustrating the operations of the printer controller 1031 and the printer engine 1036 shown in FIG. 1. More specifically, the first timing charts represents the printing protocol which defines interface signals corresponding to various physical operations (printing sequence).

In FIG. 3, T1 denotes the normal time period from the time at which the engine transmits a TOP signal to the printer controller until the time (time F1) when the leading end of the printing paper reaches the paper ejection slog F (that is, T1=F1−TOP1). Because the TOP signal is a timing signal to start transmission of image data to be printed, the normal time period T1 depends only on the printing mode and does not depend on the paper size.

T2 denotes the normal time period from the end of T1 to the time (time SAFE) when the paper is completely ejected out of the laser beam printer via the paper ejection slot F. The normal time period T2 varies depending on the paper size. At time SAFE, the printing operation for the paper is completed. When a jam occurs, if the elapsed time associated with a particular page is greater than SAFE with respect to the corresponding TOP signal, then the printing operation for that page has already been completed and thus reprinting is not necessary for that page. The PRINT signal is a signal transmitted by the printer controller 1031 to request to start a printing operation (when the PRINT signal is negative, it is TRUE). The TOP signal is a timing signal output by the engine 1036 to request the printer controller 1031 to send image data (when the TOP signal is negative, it is TRUE).

3001 denotes a time period until a visible toner image corresponding to the image data received from the printer controller 1031 is formed on the photosensitive drum 2055 and further transferred to paper. The image transferred to the paper is fixed by the fixing mechanism during the time period 3002.

FIG. 4 is a table illustrating the correspondence between the normal time period T1 shown in FIG. 3 and the resolution. FIG. 5 is a table illustrating the correspondence between the normal time period T2 shown in FIG. 3 and the resolution/size of paper.

From the tables, it can be seen that if printing is performed on A4-size paper at 600 DPI, then T1=t51 and T2=t65.

The features of the present embodiment are now described below with reference to FIG. 1 and other figures as required.

In the printing control apparatus constructed in the above-described manner for controlling the printing process performed on recording media according to printing information input from a data processing apparatus (host computer 1001) via a particular communication medium (interface, network), the recording media being fed one by one to the printing mechanism and ejected out of the main part (enclosure 2001) of the printer (through a paper ejection slot F), the printing control apparatus includes: variably setting means for variably setting the resolution of the printing mechanism (more particularly, under the control of the CPU 1033, the engine controller 1049 variably sets the feeding system, depending on the specified resolution); obtaining means (paper ejection time calculation unit 1045) for obtaining the time required for the printing process on a recording medium until ejecting the recording medium out of the main part of the printer, depending on the resolution variably set by the variably setting means; time measurement means for measuring an elapsed time (the CPU 1033 measures the elapsed time using an internal timer mechanism (not shown)); and judgment means (CPU 1033) for judging whether a recording medium has been ejected on the basis of the elapsed time measured by the time measurement means and also on the basis of the time obtained by the obtaining means. Thus, even if the resolution of the printing mechanism is changed, the time when each recording medium is ejected out of the apparatus is precisely determined and the varying processing status of each page is properly managed.

The printing control apparatus further includes detection means for detecting whether jamming occurs by monitoring the status of the operation of transporting the recording medium (more particularly, the engine controller 1049 detects jamming on the basis of a signal sent from a sensor or the like (not shown)), and scheduling means (paper ejection monitoring unit 1042) for, when jamming is detected by the detection means, rescheduling the process for each page on the basis of the judgment result given by the judgment means. Thus, even if jamming occurs during the process of transporting a recording medium in the environment where the resolution is variable, the status of the process for each page can be precisely determined and, therefore, it is possible to properly restart the process for each page after recovery from the jam without causing an already-printed page to be printed again or a not-yet-printed page to be printed again.

Furthermore, the variably setting means includes control means for controlling the speed of feeding each recording medium to the printing mechanism, depending on the specified resolution (although in this specific embodiment the resolution is set to either one of two values, that is, 600 DPI or 1200 DPI, the resolution may also be set to any one of three or more values). Thus, regardless of whatever resolution is specified, the time when each recording medium is ejected out of the apparatus is precisely determined and the varying processing status of each page is properly managed.

The resolution may be specified either via the data processing apparatus (by issuing a command from the host computer 1001) or via the control panel provided on the main part of the printer (by making a selection from a menu displayed on the control panel unit 1037) so that the resolution is automatically set to a value desired by a user or the user can set the resolution to any desired value.

Figure 6:
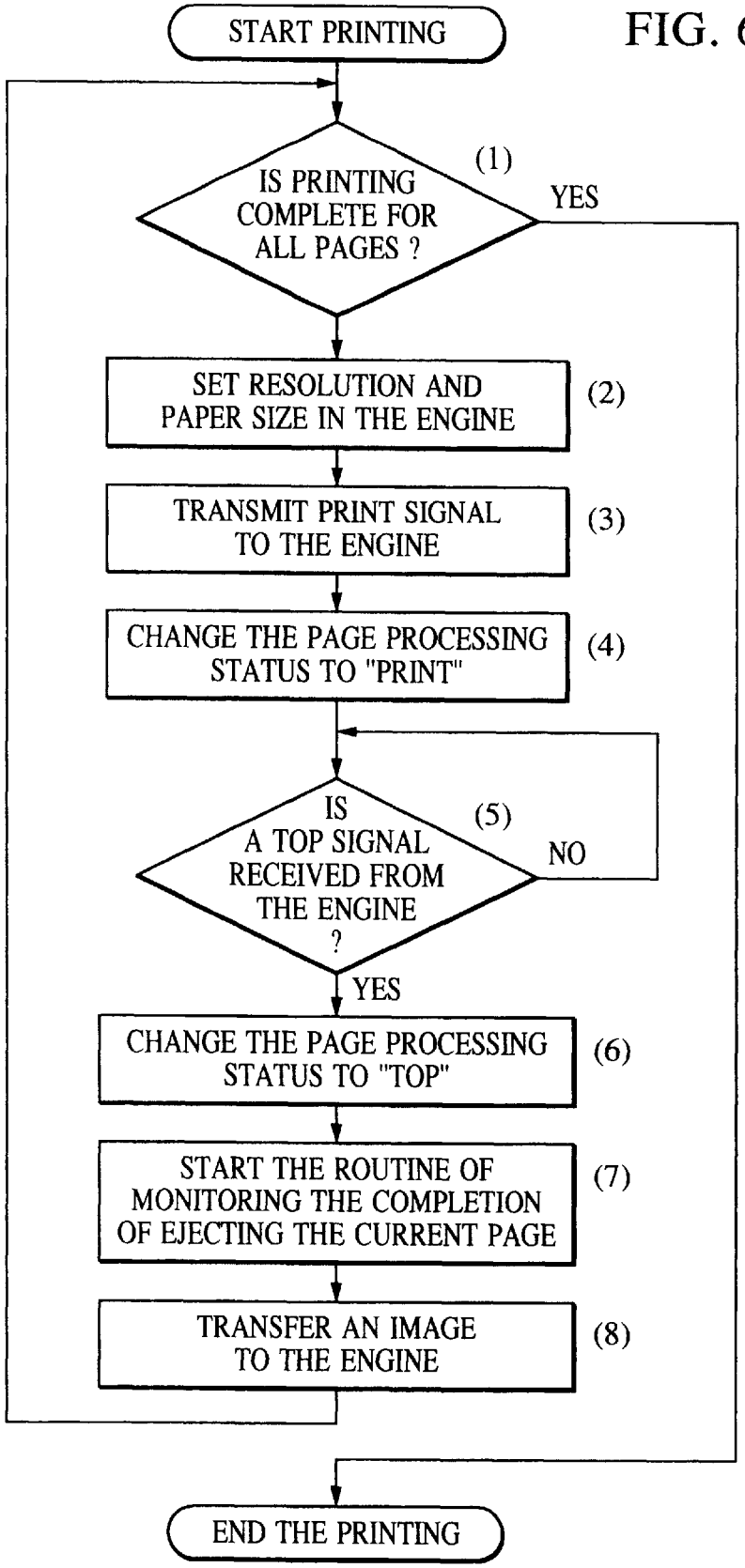
FIG. 6 is a flowchart illustrating an example of a first printing procedure performed by the printing control apparatus according to the present invention.

FIG. 6 is a flowchart illustrating an example of a first printing procedure performed by the printing control apparatus according to the present invention. More specifically, the flowchart illustrates the page printing procedure performed by the printer controller 1031. In this flowchart, numerals (1) to (8) denote step numbers. Herein, by way of example, the resolution is set to 600 DPI and A4-size plain paper is employed.

If data is received from the host computer 1001, one page of image information is generated and a printing operation is started. At the same time, a jam monitoring operation is started.

Then in step (1), it is checked to determined whether all specified pages have already been printed and printed paper has already been ejected. If all pages have been completed, the printing operation is finished.

If it is concluded in step (1) that all specified pages have not yet been ejected, then the process goes to step (2) and conditions such as the resolution of a page to be printed and the paper size are set in the printer engine 1036.

Subsequently, in step (3), a PRINT signal is output to the printer engine 1036 (at time PRINT1 shown in FIG. 3).

Then, in step (4), the operation status associated with that page is changed to "PRINT".

After that, the printer controller 1031 changes the PRINT signal to TRUE. If the printer engine 1036 detects transition of the PRINT signal to TRUE, the printer engine 1036 starts a printing operation. The printer engine 1036 sends a TOP signal with the TRUE level (when the TOP signal is negative, it becomes TRUE) to the printer controller 1031 for a predetermined period thereby requesting the printer controller 1031 to send image data. The printer controller 1031 waits in step (5) for the TOP signal to become TRUE. If transition of the TOP signal to TRUE is detected (at time TOP1 shown in FIG. 3), then, in step (6), the operation status associated with that page is changed to "TOP".

Subsequently, in step (7), a paper ejection monitoring routine (which will be described in detail later) is started to monitor the process of ejecting the current page.

Then, in step (8), one page of bitmap image data produced by the image conversion/transfer unit 1040 is transmitted as image data in synchronization with a clock signal (not shown). After that, the process returns to step (1).

FIGS. 7 and 8 illustrate examples of page processing status tables managed by the printer controller 1031 shown in FIG. 1. FIG. 7 illustrates an example where five pages are in statuses "SAFE", "SAFE", "TOP", "PRINT", and "WAIT", respectively. FIG. 8 illustrates an example where five pages are in statuses "SAFE", "SAFE", "WAIT", "WAIT", and "WAIT", respectively.

In these figures, "SAFE" denotes a status in which paper has been successfully ejected. "TOP" denotes a status where a "TOP" signal has been received. "PRINT" denotes a status where a "PRINT" signal has been transmitted and "WAIT" denotes a status where the "PRINT" signal for that page has not been transmitted yet and the page is waiting for a printing operation.

The paper ejection monitoring routine for the current page, shown in FIG. 6, is described in further detail below with reference to the flowchart shown in FIG. 9.

Figure 9:
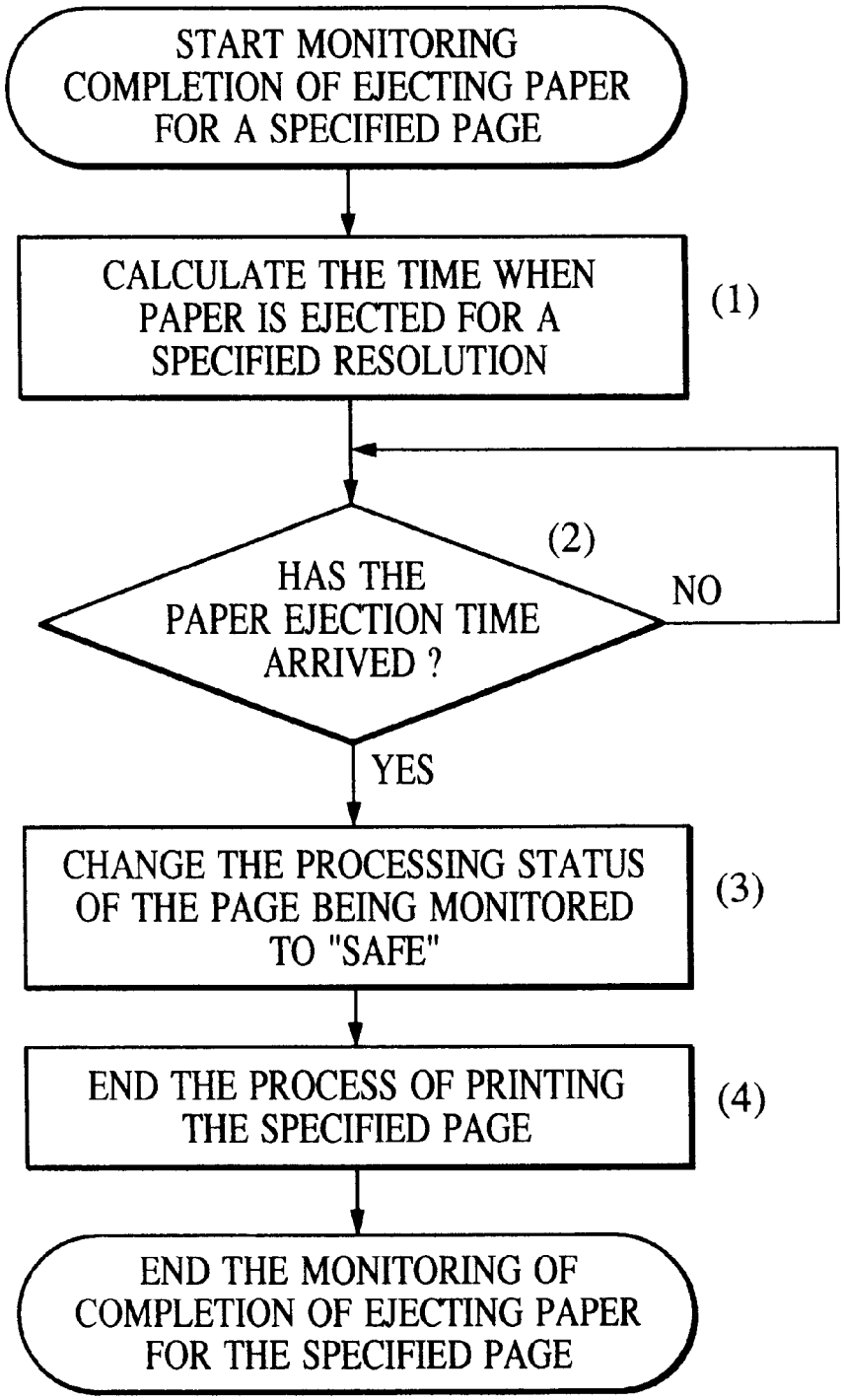
FIG. 9 is a flowchart illustrating an example of a second printing procedure performed by the printing control apparatus according to the present invention.

FIG. 9 is a flowchart illustrating an example of a second printing procedure performed by the printing control apparatus according to the present invention. More specifically, the flowchart shown in FIG. 9 represents the details of the paper ejection monitoring routine for the current page shown in FIG. 6. In this flowchart, numerals (1) to (4) denote step numbers.

In the paper ejection monitoring unit, the time SAFE (SAFE=SAFE1=T1+T2=t51+t65, in the specific example shown in FIG. 3) is first calculated in step (1). Then the routine waits in step (2) until the paper ejection completion time comes. If the paper ejection completion time has come, then in step (3) the page processing status of the page being monitored is immediately changed to SAFE. Once the page has been successfully ejected, there is no longer a possibility that it will become necessary to reprint that page due to a jam. Thus, in step (4), a post process is performed to release the memory area used for that page. Then the paper ejection completion monitoring operation for that page is finished.

In the case where there are five pages to be printed, the page processing status for each page at the time when the second page has been ejected becomes such that the first and second pages are in status SAFE and the third page is in status TOP in which paper is being transported in the apparatus after completion of receiving image data, as shown in FIG. 7.

The fourth page has received a PRINT signal and is waiting for arrival of a TOP signal to start transmission of image data. The engine 1049 has not started the printing operation for the fifth page yet because the printing operation of the fourth page is not completed.

Figure 10:
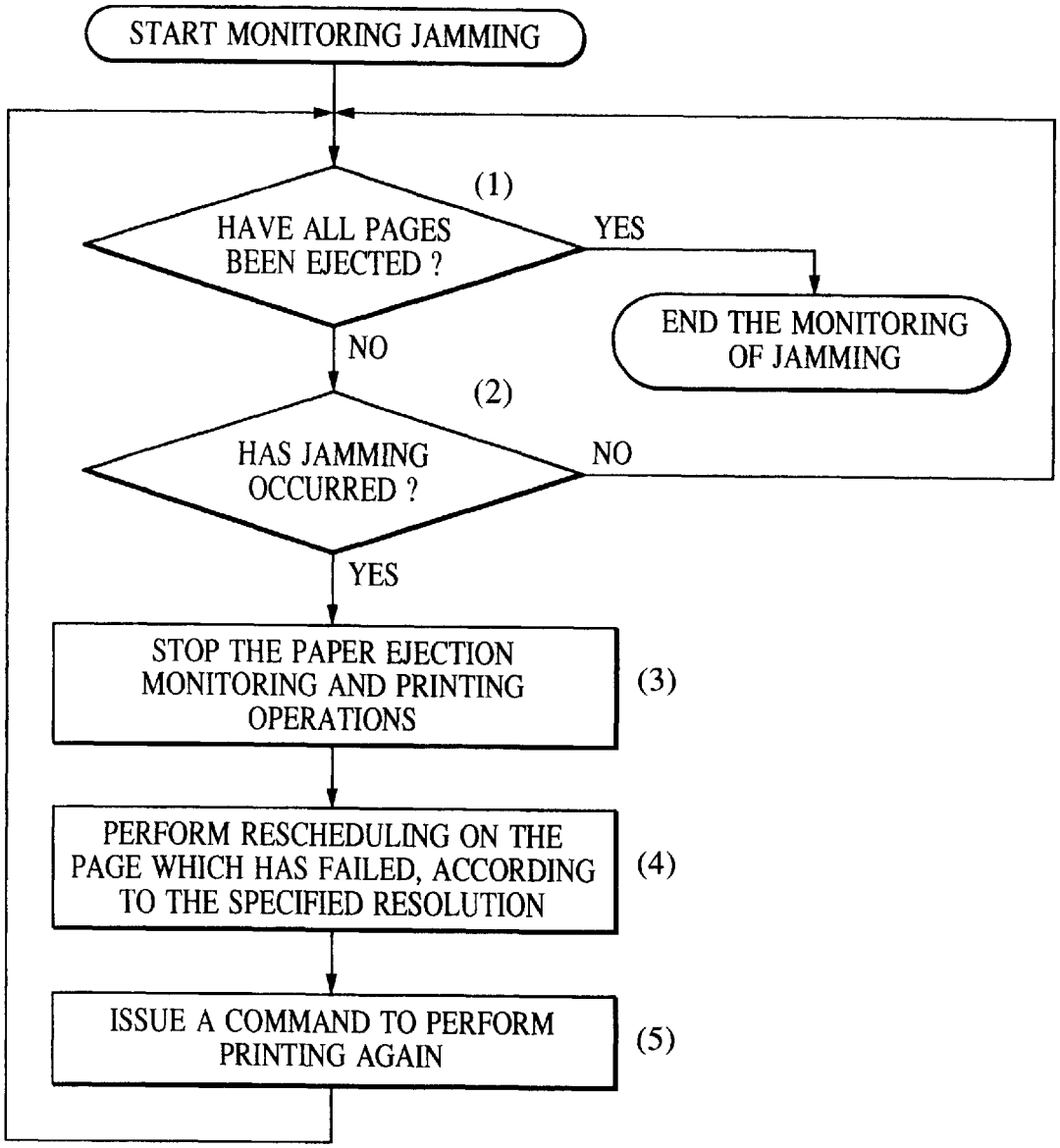
FIG. 10 is a flowchart illustrating an example of a third printing procedure performed by the printing control apparatus according to the present invention.

FIG. 10 is a flowchart illustrating an example of a third printing procedure performed by the printing control apparatus according to the present invention. More specifically, the flowchart represents the jam monitoring procedure. In this flowchart, numerals (1) to (5) denote step numbers.

At step (1), it is determined whether the status is "SAFE" for all pages. That is, it is determined whether printing is completed and paper has been ejected for all pages. If it is determined that printing is completed and paper has been ejected for all pages, then the jam monitoring is terminated.

On the other hand, if it is determined in step (1) that all pages are not in status "SAFE", the jam monitoring operation is continued because there is one or more pages to be printed. In this case, the process goes to step (2) to determine whether a jam has occurred. If it is determined that there is no jam, then the process returns to step (1). Then steps (1) and (2) are repeated to determine whether paper has been ejected for all pages and whether a jam has occurred.

If it is determined in step (2) that a jam has occurred when each page is in the page processing status, for example, such as that shown in FIG. 7, then the process goes to step (3) and the paper ejection completion monitoring operation and the printing operation are stopped and the process executes a reprinting routine to reprint the page which has not been successfully ejected because of the jam.

In this case, because printing is already completed for the first and second pages as indicated by the page processing status shown in FIG. 7, the process goes to step (4) and the status for the third and following pages are reset to "WAIT". Then rescheduling is performed for the remaining pages. Subsequently, in step (5), a command is issued to restart the printing operation. The process then returns to step (1) to perform the printing operation for the third and following pages. In this case, the processing status for each page becomes as shown in FIG. 8 when the printing operation is restarted.

As described above, the paper ejection completion is monitored for each page and jamming is also monitored so that each page is correctly printed and then ejected.

Figure 11:
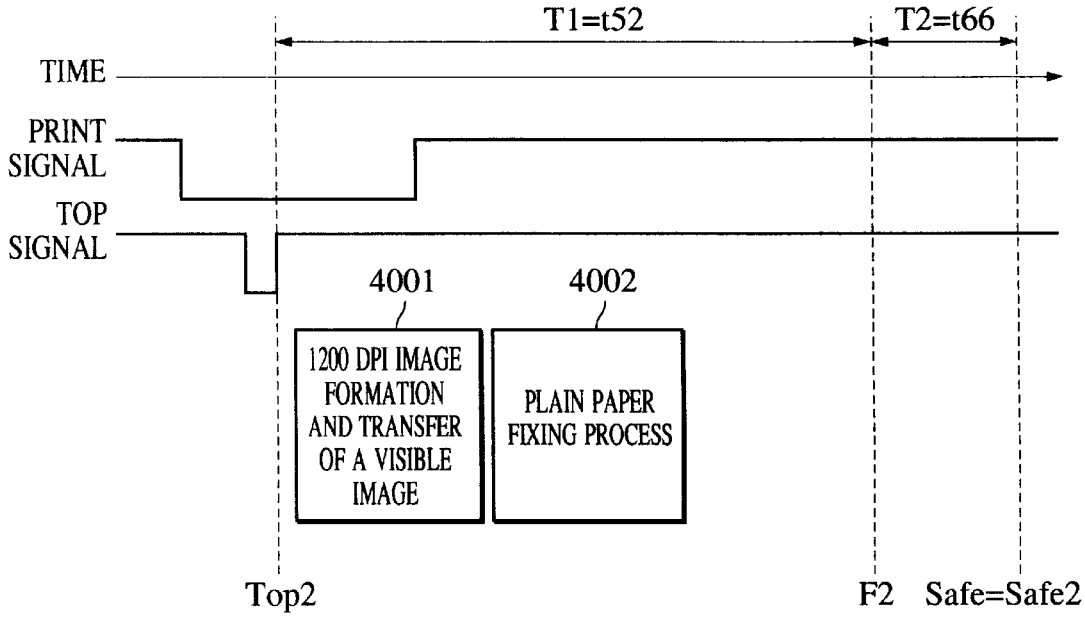
FIG. 11 is a second timing chart illustrating the operations of the printer controller and the printer engine shown in FIG. 1.

When printing is performed at 1200 DPI, the engine operates at a different processing speed. In this case, the normal time periods T1 and T2 have different values from those for 600 DPI as shown in FIG. 11. Therefore, if the time setting is made in the same manner as for 600 DPI, then the calculation on the number of pages which will be required to be reprinted when a jam occurs is wrong. As a result, a lack or duplication of a page can occur.

To avoid the above problem, the time setting is made as follows. It is determined from the tables shown in FIGS. 4 and 5 that the normal time periods T1 and T2 for A4-size plain paper at 1200 DPI are t52 and t66, respectively.

Using these values, the paper ejection monitoring unit 1042 calculates, in step (1) shown in FIG. 9, the time SAFE for 1200 DPI (SAFE=SAFE4=T1+T2=t52+t66) thereby precisely determining the paper ejection completion time. The paper ejection monitoring unit 1042 properly monitors whether jamming is occurring using the calculated paper ejection completion time.

As described above, the calculation means for calculating the paper ejection completion time depending on the resolution makes it possible to prevent a not-yet-printed page from being skipped without being printed or prevent an already-printed page from being printed again when a jam occurs in a printer of the type which includes a printing mechanism whose operation is variable depending on the resolution.

In the calculation of the paper ejection completion time according to the present embodiment, as described above, the paper ejection time is calculated using the resolution data which has been stored in advance in the memory such as a nonvolatile memory and also using the normal time periods T1 and T2 defined for the respective paper sizes. It is clear that the paper ejection completion time may also be calculated using the resolution and the paper size according to another proper formula.

The features of the present embodiment are described in further detail below with reference to the flowcharts shown in FIGS. 6, 9 and 10.

Figure 20:
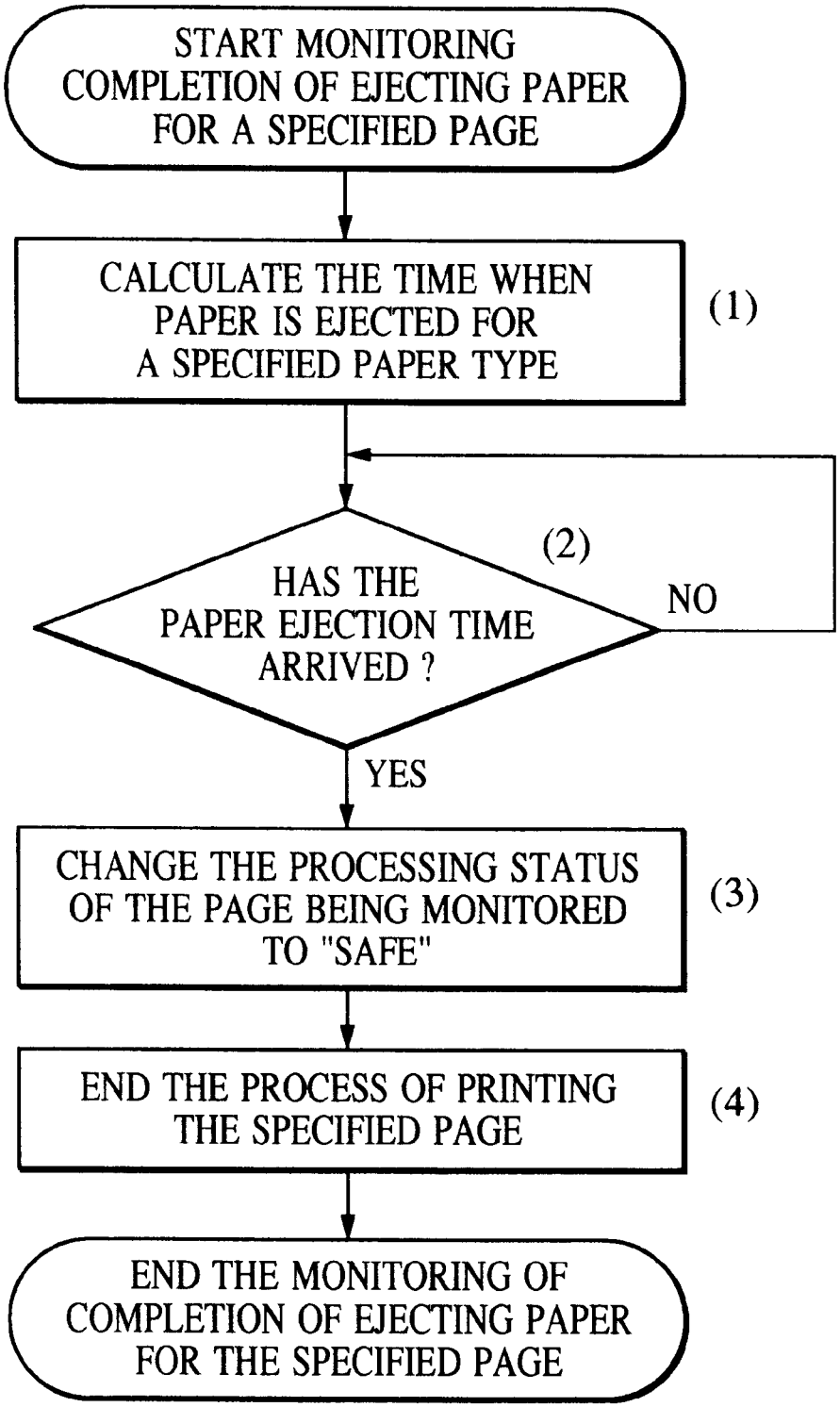
FIG. 20 is a flowchart illustrating an example of a fifth printing procedure performed by the printing control apparatus according to the present invention.

In the printing control apparatus constructed in the above-described manner for controlling the printing process performed on recording media according to printing information input from a data processing apparatus via a particular communication medium (interface, network), the recording media being fed one by one to the printing mechanism (engine 1049) and ejected out of the main part of the printer, or in the storing medium which stores a computer readable program for controlling a printer which performs a printing process on recording media according to printing information input from a data processing apparatus via a particular communication medium, the recording media being fed one by one to a printing mechanism and ejected out of the main part of a printer, the above-described method or program comprises the steps of: variably setting the resolution of the printing mechanism (step (2) in FIG. 6); calculating the time required for the printing process on a recording medium until ejecting the recording medium out of the main part of the printer, depending on the type of the medium set in said setting step (step (1) in FIG. 9); measuring an elapsed time (by an internal timer mechanism provided in the CPU 1033); judging whether a recording medium has been ejected on the basis of the elapsed time measured in the time measurement step and also on the basis of the time calculated in the calculation step (step (2) in FIG. 20). Thus, even if the resolution of the printing mechanism is changed, it is possible to precisely determine when each recording medium is ejected out of the apparatus and the varying processing status of each page is properly managed.

The method/program may further comprise the steps of: detecting whether jamming occurs by monitoring the status of the operation of transporting the recording medium (step (2) in FIG. 10); and rescheduling the process for each page on the basis of the judgment result given in the judgment step, when jamming is detected in the detecting step. (step (4) in FIG. 10). Thus, even if jamming occurs during the process of transporting a recording medium in the environment where the resolution is variable, the status of the process for each page can be precisely determined and, therefore, it is possible to properly restart the process for each page after recovery from the jam without causing an already-printed page to be printed again or a not-yet-printed page to be printed again.

Preferably, the variably setting step includes a step of controlling the speed of feeding each recording medium to the printing mechanism, depending on a specified resolution. Therefore, even if the speed of feeding each recording medium varies depending on the specified resolution and thus the time until the ejection of the recording medium out of the apparatus varies from a recording medium to another, it is possible to precisely determine when each recording medium is ejected out of the apparatus. That is, it is possible to properly manage the varying processing status of each page.

The resolution may be specified either via the data processing apparatus (by issuing a command from the host computer 1001) or via the control panel provided on the main part of the printer (by making a selection from a menu displayed on the control panel unit 1037) so that the resolution is automatically set to a value desired by a user or the user can set the resolution to any desired value.

Second Embodiment

Although in the printer according to the first embodiment described above, the paper ejection completion time is determined depending on the printing speed which varies depending on the resolution, the invention may also be applied to a printer of the type in which the printing speed varies depending on the type of printing paper. In this case, the paper ejection completion time is determined depending on the type paper (such as plain paper, OHT paper, recycled paper, thick paper, special paper (such as high gloss paper), etc.), as described below.

Figure 12:
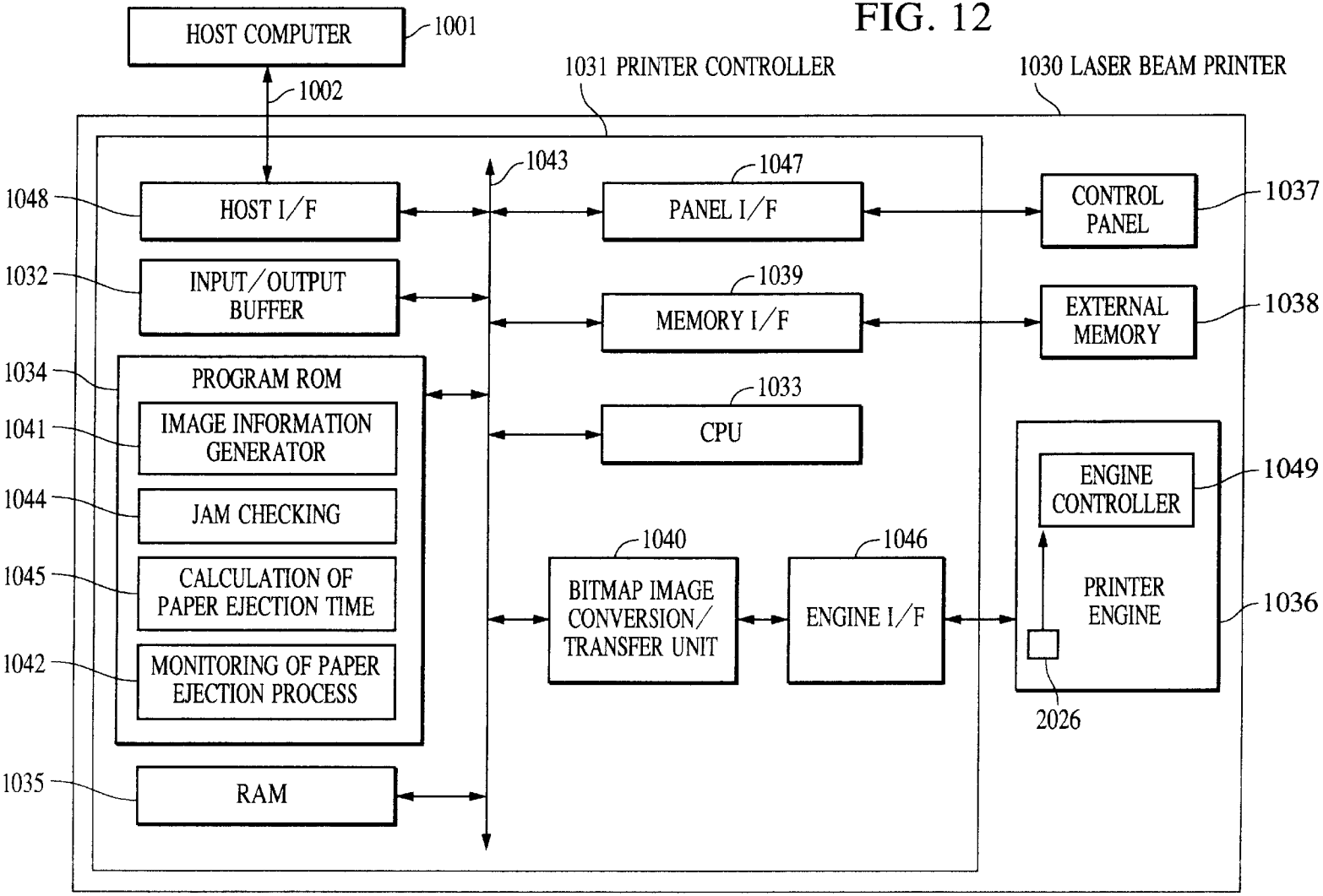
FIG. 12 is a block diagram illustrating a printing system including a printing control apparatus according to a second embodiment of the invention.

FIG. 12 is a block diagram illustrating a printing system including a printing control apparatus according to the second embodiment of the invention. In this specific embodiment, the printing system includes a host computer 1001, a laser beam printer 1030, and a communication line 1002 through which the host computer 1001 and the laser beam printer 1030 are connected to each other. Herein, similar parts to those in FIG. 1 are denoted by similar reference numerals.

As shown in FIG. 12, there is provided an optical or mechanical sensor for detecting the type of paper fed manually or automatically to determine whether the paper is plain paper, OHT paper, recycled paper, thick paper, or special paper (such as high gloss paper). The detected paper type code is sent to the CPU 1033 via the engine controller 1049. Thus, even when the printing speed varies depending on the type of printing paper, the CPU 1033 correctly determines the paper ejection completion time depending on the type of paper (such as thick paper, OHT paper, thick paper, etc.).

Figure 13:
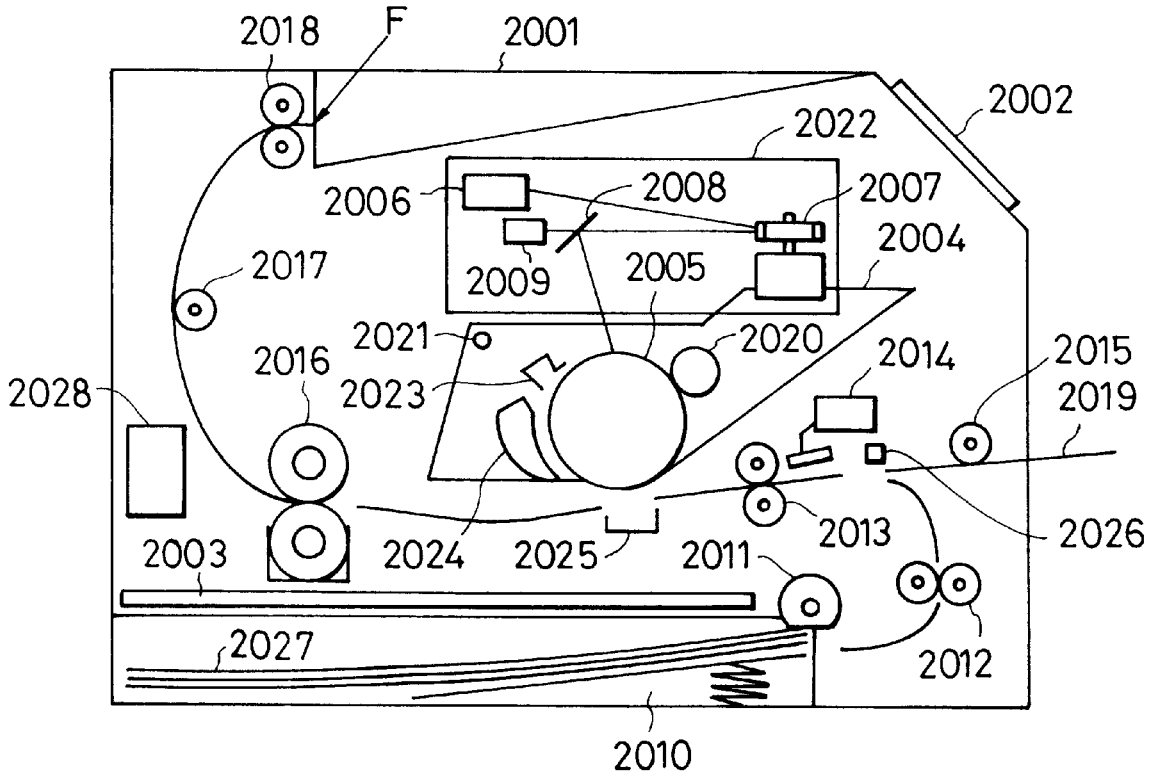
FIG. 13 is a cross-sectional view illustrating an example of the construction of the engine shown in FIG. 12.

FIG. 13 is a cross-sectional view illustrating an example of the construction of the engine 1036 shown in FIG. 12, wherein similar parts to those in FIGS. 2 or 12 are denoted by similar reference numerals.

In this second embodiment, the laser beam printer is capable of varying the time period during which paper is passed through the fixing unit 2016, depending on the type of the paper, that is, depending on whether the paper is plain paper, OHT paper, recycled paper, thick paper, or special paper (such as high gloss paper), thereby switching the toner image heating time to a longer or shorter period while maintaining the resolution constant. A sensor 2026 is disposed at a proper location to automatically detect the type of paper. This allows the laser beam printer to be set to automatically switch the printing speed depending on the type of fed paper. The type of paper may also be specified by a user by sending a command from the host computer 1001 or by inputting a command via the control panel unit 1037.

The operation of the printer controller 1031 in the above system is described below.

If the user issues a print start command via the host computer 1001, control codes and data are transmitted from the host computer 1001 via the communication line 1002.

The control codes and data received via the host I/F 1048 are stored into the RAM 1035 via the input/output buffer 1032.

In accordance with the program described in the program ROM 1034, the CPU 1033 processes data via the image information generator 1041 so as to generate image information such as graphics, characters, and image data (image objects) one by one. After completion of generating all image objects included in one page, the bitmap image conversion/transfer unit 1040 converts the image information into the form of bit map image data corresponding to the image to be actually printed and transmits the resultant bit map image data to the printer engine 1036. The printer engine 1036 prints an image on paper in accordance with the bit map image data. The bit map image is printed on paper according to a particular printing sequence depending on the paper type detected by the sensor 2026. The printed paper is ejected to the outside via the paper ejection slot F shown in FIG. 13.

Figure 14:
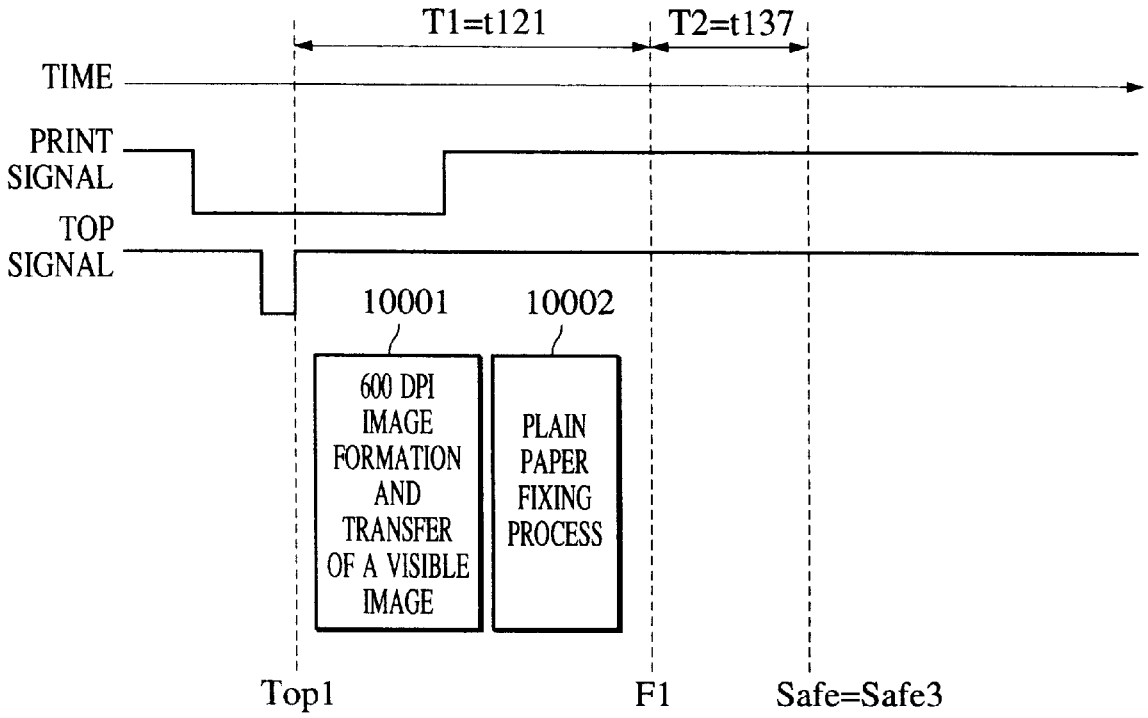
FIG. 14 is a third timing chart illustrating the operations of the printer controller and the printer engine shown in FIG. 12.

FIG. 14 is a third timing chart illustrating the operations of the printer controller 1031 and the printer engine 1036 shown in FIG. 12. More specifically, the first timing charts represents the printing protocol which defines interface signals corresponding to various physical operations (printing sequence).

In FIG. 14, T1 denotes the normal time period from the time at which the engine transmits a TOP signal to the printer controller until the time (time F1) when the leading end of the printing paper reaches the paper ejection slot F (that is, T1=F1−TOP1). Because the TOP signal is a timing signal to start transmission of image data to be printed, the normal time period T1 depends only on the printing mode and does not depend on the paper size.

T2 denotes the normal time period from the end of T2 to the time (time SAFE) when the paper is completely ejected out of the laser beam printer via the paper ejection slot F. The normal time period T2 varies depending on the paper size. At time SAFE, the printing operation for the paper is completed. When a jam occurs, if the elapsed time associated with a particular page is greater than SAFE with respect to the corresponding TOP signal, then the printing operation for that page has already been completed and thus reprinting is not necessary for that page. The PRINT signal is a signal transmitted by the printer controller 1031 to request to start a printing operation (when the PRINT signal is negative, it is TRUE). A TOP signal is a timing signal output by the engine 1036 to request the printer controller 1031 to send image data (when the TOP signal is negative, it is TRUE).

10001 denotes a time period until a visible toner image corresponding to the image data received from the printer controller 1031 is formed on the photosensitive drum 2055 and further transferred to paper. The image transferred onto the paper is fixed by the fixing mechanism during the fixing process 10002 in the time period T1.

FIG. 15 shows the correspondence between the normal time period T1 shown in FIG. 14 and the type of paper utilized. FIG. 16 is a table illustrating the correspondence between the normal time period T2 shown in FIG. 14 and the paper type or paper size.

From FIGS. 15 and 16, it can be seen that if printing is performed on A4-size paper at 600 DPI, then T1=t121 and T2=t137.

The features of the present embodiment are now described below with reference to FIG. 12 and other figures as required.

In the printing control apparatus constructed in the above-described manner for controlling the printing process performed on recording media according to printing information input from a data processing apparatus (host computer 1001) via a particular communication medium (interface, network), the recording media being fed one by one to the printing mechanism and ejected out of the main part (enclosure 2001) of the printer (through a paper ejection slot F), the printing control apparatus includes: setting means for setting the type of a recording medium to be subjected to a printing operation (under the control of the CPU 1033, the engine controller 1049 performs the setting depending on the type of the recording medium); calculation means (paper ejection time calculation unit 1045) for calculating the time required for the printing process on a recording medium until ejecting the recording medium out of the main part of the printer, depending on the type of the medium set by the setting means; time measurement means for measuring an elapsed time (the CPU 1033 measures the elapsed time using an internal timer mechanism (not shown)); and judgment means (CPU 1033) for judging whether a recording medium has been ejected on the basis of the elapsed time measured by the time measurement means and also on the basis of the time calculated by the calculation means. Thus, regardless of the type of the recording medium fed to the printing mechanism, it is possible to precisely determine when each recording medium is ejected out of the apparatus and the varying processing status of each page is properly managed.

The printing control apparatus further includes: detection means for detecting whether jamming occurs by monitoring the status of the operation of transporting the recording medium (more particularly, the engine controller 1049 detects jamming on the basis of a signal sent from a sensor or the like (not shown)), and scheduling means (paper ejection monitoring unit 1042) for, when jamming is detected by the detection means, rescheduling the process for each page on the basis of the judgment result given by the judgment means. This ensures that even if jamming occurs during the process of transporting a recording medium in the environment where two or more different types of recording media may be used, the status of the process for each page can be precisely determined and, therefore, it is possible to properly restart the process for each page after recovery from the jam, thereby making it possible to prevent an already-printed page from being printed again and prevent a not-yet-printed page from being skipped without being printed.

Furthermore, the above-described setting means preferably includes control means for controlling the speed of feeding each recording medium to the printing mechanism, depending on the type of the recording medium being fed. Therefore, even if the speed of feeding each recording medium varies depending on the type of the recording medium and thus the time until the ejection of the recording medium out of the apparatus varies from one recording medium to another, it is possible to precisely determine when each recording medium is ejected out of the apparatus and the varying processing status of each page is properly managed.

The type of the recording medium may be specified either via the data processing apparatus (by issuing a command from the host computer 1001) or via the control panel provided on the main part of the printer (by making a selection from a menu displayed on the control panel unit 1037). That is, the type of recording medium desired by the user can be automatically specified or manually specified by the user.

The printing control apparatus further includes identifying means for automatically identifying the type of the recording medium being passed through a predetermined location (the engine controller 1049 perform the identifying process on the basis of the output from the sensor 2026).

Preferably, the identifying means (sensor 2026) identifies the type of the recording medium being passed through the predetermined location so as to determine whether the recording medium is plain paper, OHT paper, recycled paper, thick paper or special paper. Thus, it is possible to automatically set the paper transporting speed to an optimum value depending on the identification result indicating whether the recording medium is plain paper, OHT paper, recycled paper, thick paper or special paper.

Figure 17:
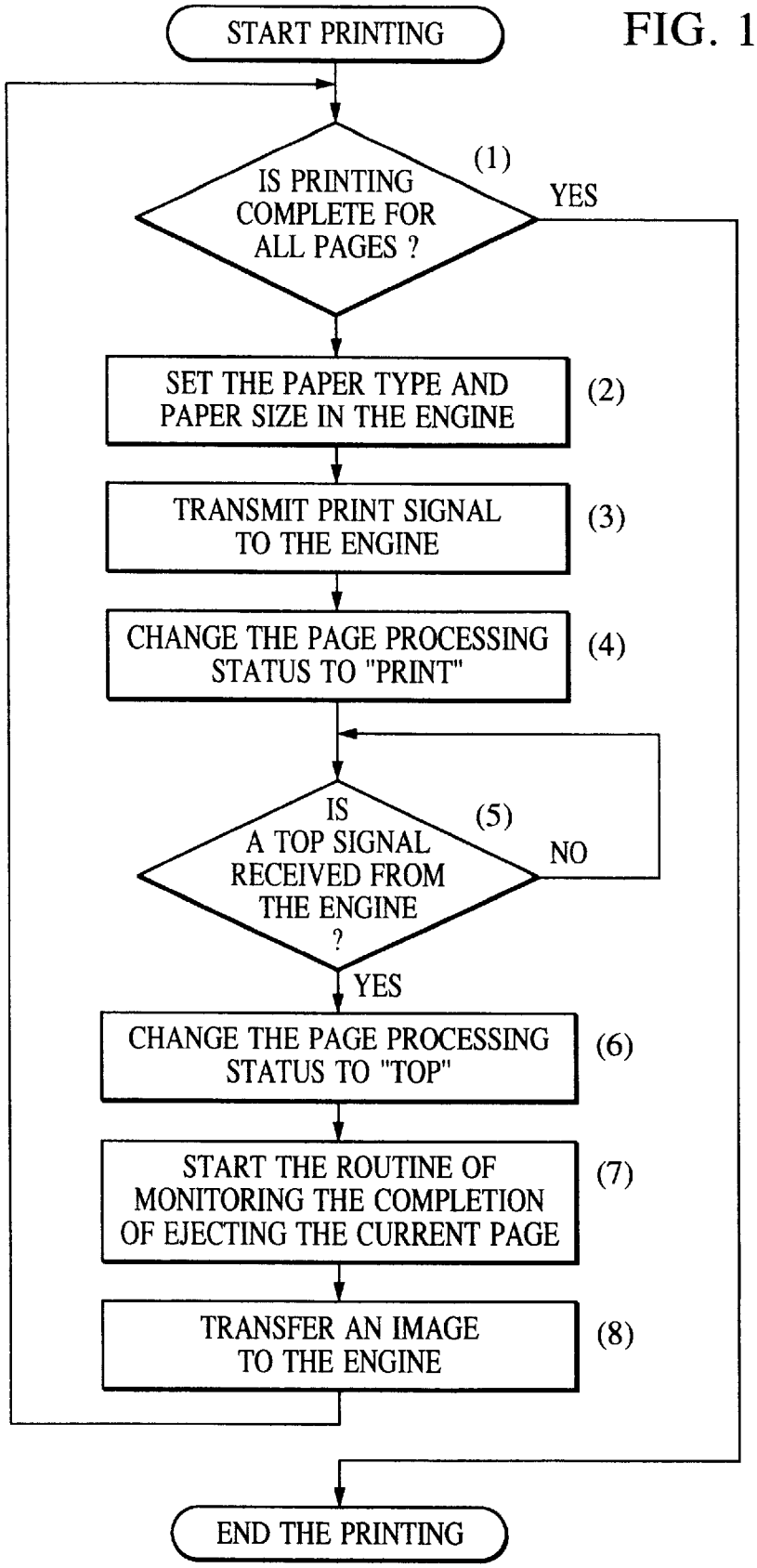
FIG. 17 is a flowchart illustrating an example of a fourth printing procedure performed by the printing control apparatus according to the present invention.

FIG. 17 is a flowchart illustrating an example of a fourth printing procedure performed by the printing control apparatus according to the present invention. More specifically, the flowchart illustrates the page printing procedure performed by the printer controller 1031. In this flowchart, numerals (1) to (8) denote step numbers. Herein, by way of example, the resolution is set to 600 DPI and A4-size plain paper is employed.

If data is received from the host computer 1001, one page of image information is generated and a printing operation is started. At the same time, a jam monitoring operation is started.

Then in step 1, a check is made to determine whether all specified pages have been printed and printed paper has been ejected. If all pages have been completed, the printing operation is finished.

If it is concluded in step (1) that all specified pages have not been ejected yet, then the process goes to step (2) and conditions such as the type and size of paper on which the next page is to be printed are set in the engine 1036.

Then in step (3), a PRINT signal is output to the engine 1036 (at time PRINT1 shown in FIG. 3). Subsequently, in step (4), the operation status associated with that page is changed to "PRINT".

After that, the printer controller 1031 changes the PRINT signal to TRUE. If the engine 1036 detects transition of the PRINT signal to TRUE, the engine 1036 starts a printing operation. The engine 1036 sends a TOP signal with the TRUE level (when the TOP signal is negative, it becomes TRUE) to the printer controller 1031 for a predetermined period thereby requesting the printer controller 1031 to send image data. The printer controller 1031 waits in step (5) until the TOP signal becomes TRUE. If transition of the TOP signal to TRUE is detected (at time TOP1 shown in FIG. 3), then, in step (6), the operation status associated with that page is changed to "TOP".

Subsequently, in step (7), paper ejection monitoring routine (which will be described in detail later) for the current page is started to monitor the process of ejecting that page.

Then, in step (8), one page of bitmap image data produced by the image conversion/transfer unit 1040 is transmitted as image data in synchronization with a clock signal (not shown). After that, the process returns to step (1).

FIGS. 18 and 19 illustrate examples of page processing status tables managed by the printer controller 1031 shown in FIG. 12. FIG. 18 illustrates an example where six pages are in statuses "SAFE", "SAFE", "TOP", "PRINT", "WAIT", and "WAIT", respectively. FIG. 19 illustrates an example where six pages are in statuses "SAFE", "SAFE", "WAIT", "WAIT", "WAIT", and "WAIT", respectively.

In these figures, "SAFE" denotes a status in which paper has been successfully ejected. "TOP" denotes a status where a "TOP" signal is being received. "PRINT" denotes a status where a "PRINT" signal is being transmitted and "WAIT" denotes a status where the "PRINT" signal for that page has not been transmitted yet and the page is waiting for a printing operation.

The paper ejection monitoring routine for the current page, shown in FIG. 17, is described in further detail below with reference to the flowchart shown in FIG. 20.

FIG. 20 is a flowchart illustrating an example of a fifth printing procedure performed by the printing control apparatus according to the present invention. More specifically, the flowchart shown in FIG. 20 represents the details of the paper ejection monitoring routine for the current page shown in FIG. 17. In this flowchart, numerals (1) to (4) denote step numbers.

In the paper ejection monitoring unit 1042, time SAFE (SAFE=SAFE3=T1+T2=t121+t137, in the specific example shown in FIG. 14) is first calculated in step (1) depending on the type of paper. Then the routine waits in step (2) until the paper ejection completion time. If the paper ejection completion time has come, then in step (3) the page processing status of the page being monitored is immediately changed to SAFE. Once the page has been successfully ejected, there is no longer possibility that it becomes necessary to reprint that page due to a jam. Thus, in step (4), a post process is performed to release the memory area used for that page. Then the paper ejection completion monitoring operation for that page is finished.

The determination in step (2) is performed by comparing the calculated time obtained in step (1) with a value of a timer (not shown), or by detecting a time-up of a timer, to which the calculated time obtained in step (1) was set. In the above example, the timer starts in response to the TOP signal, but the time may start at another timing, for example a detecting timing of a leading or a trailing edge of paper by paper detecting means at the paper conveying path.

In the case where there are six pages to be printed, the page processing status for each page at the time when the second page has been ejected becomes such that the first and second pages are in status SAFE and the third page is in status TOP in which paper is being transported in the apparatus after reception of image data, as shown in FIG. 18.

The fourth page has received a PRINT signal and is waiting for arrival of a TOP signal to start transmission of image data. The engine 1049 has not started the printing operation for the fifth and sixth pages yet because the printing operation of the fourth page is not completed.

Figure 21:
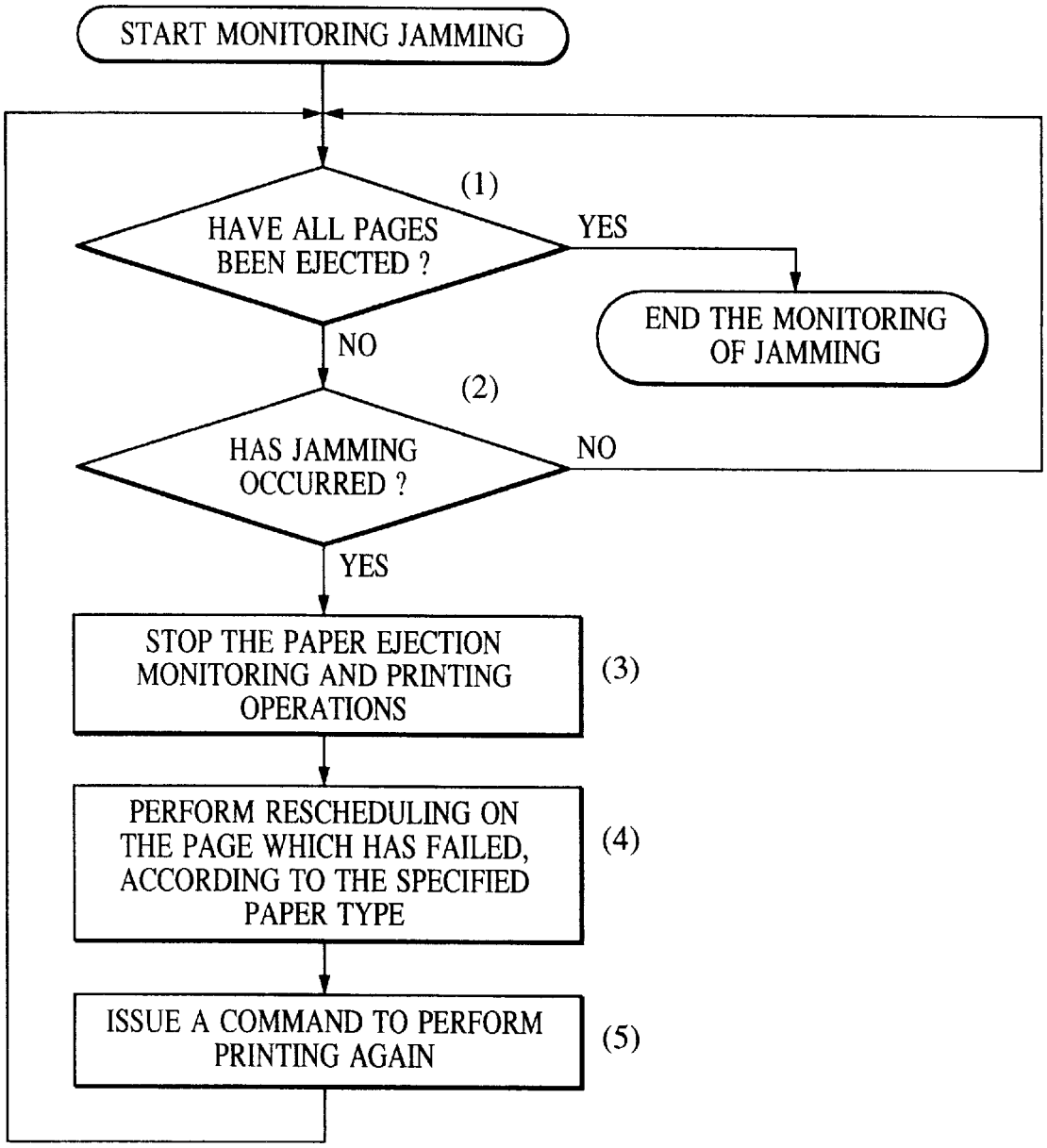
FIG. 21 is a flowchart illustrating an example of a sixth printing procedure performed by the printing control apparatus according to the present invention.

FIG. 21 is a flowchart illustrating an example of a sixth printing procedure performed by the printing control apparatus according to the present invention. More specifically, the flowchart represents the jam monitoring procedure. In this flowchart, numerals (1) to (5) denote step numbers.

At first step (1), it is determined whether the status is "SAFE" for all pages. That is, it is determined whether printing is completed and paper has been ejected for all pages. If it is determined that printing are completed and paper has been ejected for all pages, then the jam monitoring is terminated.

On the other hand, if it is determined in step (1) that all pages are not in status "SAFE", the jam monitoring operation is continued because there is one or more pages to be printed. In this case, the process goes to step (2) to determine whether a jam has occurred. If it is determined that there is no jam, then the process returns to step (1). Then steps (1) and (2) are repeated to determine whether paper has been ejected for all pages and whether a jam has occurred.

If it is determined in step (2) that a jam has occurred for example when each page is in the page processing status shown in FIG. 18, then the process goes to step (3) and the paper ejection completion monitoring operation and the printing operation are stopped and the process executes a reprinting routine to reprint the page which has not been successfully ejected because of the jam.

In this case, because printing is completed for the first and second pages as indicated by the page processing status shown in FIG. 18, the process goes to step (4) and the status for the third and following pages are reset to "WAIT". Then rescheduling is performed for the remaining pages, depending on the type of paper. Subsequently, in step (5), a command is issued to restart the printing operation. The process then returns to step (1) to perform the printing operation for the third and following pages. In this case, the processing status for each page becomes as shown in FIG. 19 when the printing operation is restarted.

As described above, the paper ejection completion is monitored for each page and jamming is also monitored so that each page is correctly printed and then ejected.

Figure 22:
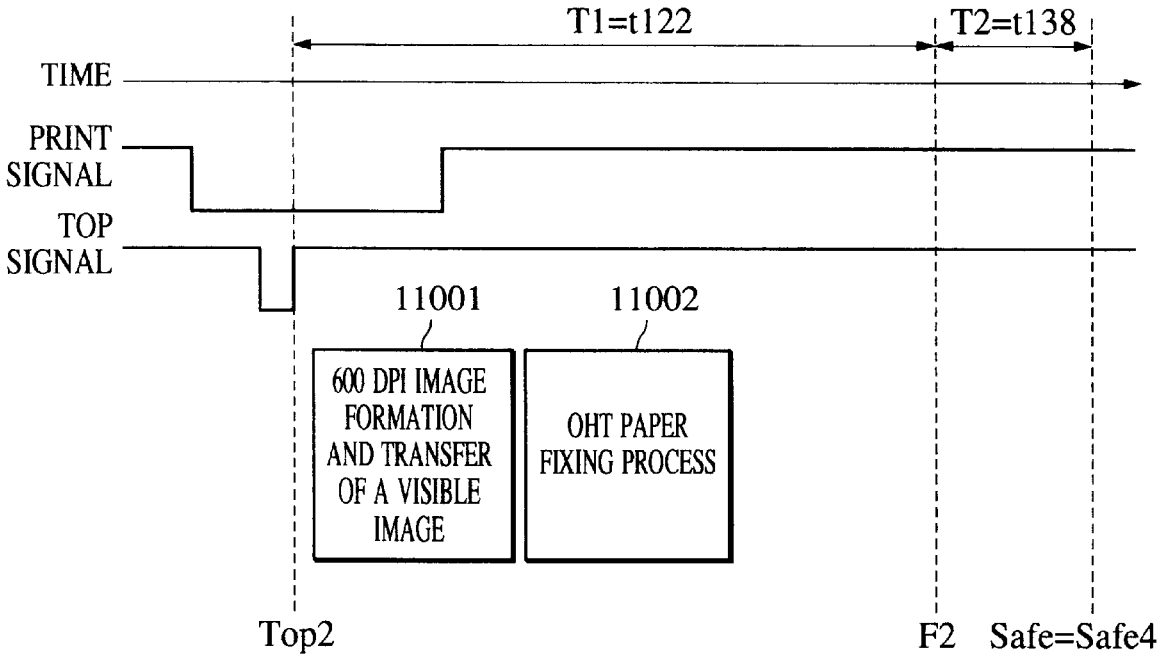
FIG. 22 is a fourth timing chart illustrating the operations of the printer controller and the printer engine shown in FIG. 12.

When printing is performed on OHT paper, the engine operates at a different processing speed. In this case, the normal time periods T1 and T2 have different values from those for plain paper as shown in FIG. 22. Therefore, if time setting is performed in the same manner as that for plain paper, then the calculation on the number of pages which will be required to be reprinted when a jam occurs is wrong. As a result, a lack or duplication of a page can occur.

To avoid the above problem, the time setting is made as follows. It is determined from the tables shown in FIGS. 15 and 16 that the normal time periods T1 and T2 for OHT paper are t122 and t138, respectively.

In the paper ejection monitoring unit 1042, time SAFE (SAFE=SAFE4=T1+T2=t122+t138)) for OHT paper is calculated in step (1) shown in FIG. 20 thereby precisely determining the paper ejection completion time. Thus, the processing status is correctly updated when OHT paper is employed. Therefore, when a jam occurs, it is possible to restart the printing operation without creating a lack or duplication of a page.

As described above, the calculation means for calculating the paper ejection completion time depending on the type of the recording medium makes it possible to prevent a not-yet-printed page from being skipped without being printed or prevent an already-printed page from being printed again when a jam occurs in a printer of the type which includes a printing mechanism whose operation is variable depending on the type of the recording medium.

In the calculation of the paper ejection completion time according to the present embodiment, as described above, the paper ejection time is calculated using the normal time periods which have been defined in advance for the respective paper types and paper sizes, It is clear that the paper ejection completion time for the respective paper types and paper sizes may also be calculated according to another proper formula.

The features of the present embodiment are described in further detail below with reference to the flowcharts shown in FIGS. 17, 20 and 21.

In the printing control apparatus constructed in the above-described manner for controlling the printing process performed on recording media according to printing information input from a data processing apparatus (host computer 1001) via a particular communication medium (interface, network), the recording media being fed one by one to the printing mechanism and ejected out of the main part of the printer, or in the storing medium which stores a computer readable program for controlling a printer which performs a printing process on recording media according to printing information input from a data processing apparatus via a particular communication medium, said recording media being fed one by one to a printing mechanism and ejected out of the main part of a printer, the method/program comprises the steps of: setting the type of a recording medium to be subjected to a printing operation (step (2) in FIG. 17); calculating the time required for the printing process on a recording medium until ejecting the recording medium out of the main part of the printer, depending on the type of the medium set in said setting step (step (1) in FIG. 20); measuring an elapsed time (by the internal timer mechanism in the CPU 1033); and judging whether a recording medium has been ejected on the basis of the elapsed time measured in the time measurement step and also on the basis of the time calculated in the calculation step (step (2) in FIG. 20). Thus, even if the type of the recording medium is changed, it is possible to precisely determine when each recording medium is ejected out of the apparatus and the varying processing status of each page is properly managed.

Preferably, the method/program may further include the steps of: detecting whether jamming occurs by monitoring the status of the operation of transporting the recording medium (step (2) in FIG. 21); and rescheduling the process for each page on the basis of the judgment result given in the judgment step, when jamming is detected in the detecting step (steps (3) and (4) in FIG. 10). Thus, even if jamming occurs during the process of transporting a recording medium in the environment where two or more different types of recording media may be used, the status of the process for each page can be precisely determined and, therefore, it is possible to properly restart the process for each page after recovery from the jam, thereby making it possible to prevent an already-printed page from being printed again and prevent a not-yet-printed page from being skipped without being printed.

Furthermore, the setting step preferably includes a step of controlling the speed of feeding each recording medium to the printing mechanism, depending on the type of the recording medium being fed. Therefore, even if the speed of feeding each recording medium varies depending on the type of the recording medium and thus the time until the ejection of the recording medium out of the apparatus varies from one recording medium to another, it is possible to precisely determine when each recording medium is ejected out of the apparatus and the varying processing status of each page is properly managed.

Furthermore, the type of the recording medium can be specified via the data processing apparatus or via the panel provided on the main part of the printer. That is, the type of recording medium desired by the user can be automatically specified or manually by the user.

Furthermore, the method/program preferably includes an identifying step (not shown) for automatically identifying the type of the recording medium being passed through a predetermined location whereby the type of the recording medium being fed is automatically detected and the paper transporting speed is automatically set to an optimum value.

Furthermore, the identifying step identifies the type of the recording medium being passed through the predetermined location so as to determine whether the recording medium is plain paper, OHT paper, recycled paper, thick paper or special paper. Thus, it is possible to automatically set the paper transporting speed to an optimum value depending on the identification result indicating whether the recording medium is plain paper, OHT paper, recycled paper, thick paper or special paper.

In the above discussion, the printer including the printing mechanism whose operation is variable depending on the resolution and the printer including the printing mechanism whose operation is variable depending on the type of recording media are described separately, in the first and second embodiments, respectively. However, the present invention may also be applied to a printer of the type including a printing mechanism whose operation is variable depending on both the resolution and the type of the recording medium so that the normal paper ejection completion time is calculated depending on the resolution and the type of the recording medium thereby making it possible to prevent a not-yet-printed page from being skipped without being printed or prevent an already-printed page from being printed again when a jam occurs.

Referring to the memory map shown in FIG. 23, the data processing program readable by the printing system including the printing control apparatus according to the present invention is described below.

FIG. 23 is a schematic representation of a memory map of a storage medium for storing various data processing programs readable by the printing system including the printing control apparatus according to the present invention.

Although not shown in the figure, information used to manage the programs stored on the storage medium, such as version information and a programmer's name may also be stored on the storage medium. Furthermore, information such as icon information for identifying programs, which depends on the OS used in the system which reads the programs, may also be stored on the storage medium.

Data associated with the programs is also managed in the above directory. Furthermore, a program used to install the programs onto a computer or a program used to decompress a compressed program may also be stored on the storage medium.

The functions realized in the above embodiments described above with reference to FIGS. 6, 9, 10, 17, 20, and 21 may also be realized by executing a program which is installed on the host computer from an external program source. That is, the technique in which information including the program is supplied to an output device from a storage medium such as a CD-ROM, a flush memory, or a FD, or from an external storage medium via a network so as to realize the above functions is also falls within the scope of the present invention.

Furthermore, the objects of the present invention may also be achieved by supplying a storage medium, on which a software program implementing the functions of any of the embodiments described above is stored, to a system or an apparatus whereby a computer (CPU or MPU) in the system or apparatus reads and executes the program code stored on the storage medium.

In this case, it should be understood that the program code read from the storage medium implements the novel functions of invention and thus the storage medium storing the program code falls within the scope of present invention.

Storage media which can be preferably employed in the present invention to supply the program code include a floppy disk, hard disk, optical disk, magneto-optical disk, CD-ROM, CD-R, magnetic tape, nonvolatile memory card, ROM, and EEPROM.

Furthermore, the scope of the present invention includes not only a system in which the functions of the embodiments described above are implemented simply by reading and executing a program code on a computer but also a system in which a part of or the whole of a process instructed by the program code is performed using an OS (operating system) on the computer.

Furthermore, the scope of the present invention also includes a system in which a program code is transferred once from a storage medium into a memory provided in a function extension board inserted in a computer or provided in a function extension unit connected to the computer, and then a part of or the whole of process instructed by the program code is performed by a CPU or the like in the function extension board or the function extension unit thereby implementing the functions of any embodiment described above.

According to the embodiments, as described above, there are provided time measurement means for measuring an elapsed time from the start of a printing operation, and calculation means for calculating the paper ejection completion time period from the start of the printing operation to the completion of ejecting a recording medium via the printing mechanism thereby making it possible to prevent a not-yet-printed page from being skipped without being printed and prevent an already-printed page from being printed again when a jam occurs. Furthermore, there is provided calculation means for calculating the paper ejection completion time depending on the resolution thereby making it possible to prevent a not-yet-printed page from being skipped without being printed or prevent an already-printed page from being printed again when a jam occurs in a printer of the type which includes a printing mechanism whose operation is variable depending on the resolution.

Furthermore, there is provided calculation means for calculating the paper ejection completion time depending on the type of recording medium thereby also making it possible to prevent a not-yet-printed page from being skipped without being printed and prevent an already-printed page from being printed again when a jam occurs in a printer of the type which includes a printing mechanism whose operation is variable depending on the type of the recording medium.

Although in the above-described embodiments, various control programs 1044, 1045, and 1042 are stored in the program ROM 1034, the functions of these control programs may also be achieved by reading programs stored on any other type of storage medium (floppy disk, MO, CD-ROM, rewritable flush ROM) or by means of communication with a program supplying source (host or external site) via a communication medium (interface, network, Internet) using a proper protocol.

In the above embodiments, the printer is assumed to be of the type in which a single color of toner (black toner) is used to form an image, and the paper transporting speed is varied depending on the fixing time required by the fixing mechanism to perform the fixing process. However, the invention may also be applied to a color printer including an intermediate transferring member for transferring a developed color image onto a recording medium being transported wherein the paper transporting speed during the color image printing process is varied to obtain an optimum transferring process time period depending on the type of the recording medium.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A printing control apparatus for controlling a printing process according to printing information input from a data processing apparatus, said printing control apparatus comprising:

variably setting means for variably setting a resolution of a printing mechanism;

obtaining means for obtaining a time required from a predetermined time until ejecting a recording medium out of the printer, on the basis of the resolution variably set by said variably setting means;

time measurement means for measuring an elapsed time from the predetermined time; and judgment means for judging whether a recording medium has been ejected, on the basis of the elapsed time measured by said time measurement means and the obtained time obtained by said obtaining means.

2. A printing control apparatus according to claim 1, further comprising:

detection means for detecting whether jamming occurs, the detection done by monitoring the status of the operation of transporting the recording medium; and scheduling means for, when jamming is detected by said detection means, rescheduling the process for each page on the basis of the judgment result given by said judgment means.

3. A printing control apparatus according to claim 1, wherein said variably setting means includes means for controlling a feeding speed of each recording medium to said printing mechanism, in accordance with a specified resolution.

4. A printing control apparatus according to claim 1, wherein said resolution is specified via one of said data processing apparatus and a panel provided on said printer.

5. A printing control apparatus for controlling a printing process according to printing information input from a data processing apparatus, said printing control apparatus comprising:

setting means for setting a type of a recording medium to be subjected to a printing operation;

obtaining means for obtaining a time required from a predetermined time until ejecting the recording medium out of the printer, on the basis of the type of the recording medium set by said setting means;

time measurement means for measuring an elapsed time from the predetermined time; and judgment means for judging whether a recording medium has been ejected on the basis of the elapsed time measured by said time measurement means and the obtained time obtained by said obtaining means.

6. A printing control apparatus according to claim 5, further comprising:

detection means for detecting whether jamming occurs, the detection done by monitoring the status of the operation of transporting the recording medium; and scheduling means for, when jamming is detected by said detection means, rescheduling the process for each page on the basis of the judgment result given by said judgment means.

7. A printing control apparatus according to claim 5, wherein said setting means includes means for controlling a feeding speed of each recording medium to a printing mechanism, depending on the type of the recording medium being fed.

8. A printing control apparatus according to claim 5, wherein the type of the recording medium is specified via one of a panel provided on said printer and said data processing apparatus.

9. A printing control apparatus according to claim 5, further comprising identifying means for automatically identifying the type of the recording medium being passed through a predetermined location.

10. A printing control apparatus according to claim 9, wherein the type of recording medium identified by said identifying means includes at least one of plain paper, OHT paper, recycled paper, thick paper, and special paper.

11. A printing method with a printing control apparatus for controlling a printing process according to printing information input from a data processing apparatus, said printing method comprising the steps of:

variably setting a resolution of a printing mechanism;

obtaining a time required from a predetermined time until ejecting a recording medium out of the printer, on the basis of the resolution variably set in said variably setting step;

measuring an elapsed time from the predetermined time; and judging whether a recording medium has been ejected on the basis of the elapsed time measured and the obtaining time obtained in said obtaining step.

12. A printing method with a printing control apparatus, according to claim 11, further comprising the steps of:

detecting whether jamming occurs, said detecting done by monitoring the status of the operation of transporting the recording medium; and rescheduling the process for each page on the basis of the judgment result given in said judgment step, when jamming is detected in said detection step.

13. A printing method with a printing control apparatus, according to claim 11, wherein said variably setting step includes a step of controlling a feeding speed of each recording medium to said printing mechanism, in accordance with a specified resolution.

14. A printing method with a printing control apparatus, according to claim 11, wherein said resolution is specified via one of said data processing apparatus and a panel provided on said printer.

15. A printing method with a printing control apparatus for controlling a printing process according to printing information input from a data processing apparatus, said printing method comprising the steps of:

setting a type of a recording medium to be subjected to a printing operation;

obtaining a time required from a predetermined time until ejecting the recording medium out of the printer, on the basis of the type of the recording medium set in said setting step;

measuring an elapsed time from the predetermined time; and judging whether a recording medium has been ejected on the basis of the elapsed time measured in said time measurement step and the obtained time obtained in said obtaining step.

16. A printing method with a printing control apparatus, according to claim 15, further comprising the steps of:

detecting whether jamming occurs, said detecting done by monitoring the status of the operation of transporting the recording medium; and rescheduling the process for each page on the basis of the judgment result given in said judgment step, when jamming is detected in said detection step.

17. A printing method with a printing control apparatus, according to claim 15, wherein said setting step includes a step of controlling a feeding speed of each recording medium to a printing mechanism, depending on the type of the recording medium being fed.

18. A printing method with a printing control apparatus, according to claim 15, wherein the type of the recording medium is specified via one of a panel provided on said printer and said data processing apparatus.

19. A printing method with a printing control apparatus, according to claim 15, further comprising an identifying step for automatically identifying the type of the recording medium being passed through a predetermined location.

20. A printing method with a printing control apparatus, according to claim 19, where in the type of recording medium identified by said identifying step includes at least one of plain paper, OHT paper, recycled paper, thick paper and special paper.

21. A storing medium which stores a computer readable program for controlling a printer which performs a printing process according to printing information input from a data processing apparatus, said program comprising the steps of:

variably setting a resolution of a printing mechanism;

obtaining a time required from a predetermined time until ejecting the recording medium out of the printer, on the basis of the resolution variably set in said variably setting step;

measuring an elapsed time from the predetermined time; and judging whether a recording medium has been ejected on the basis of the elapsed time measured in said measuring step and the obtained time obtained in said obtaining step.

22. A storage medium on which the computer readable program is stored, according to claim 21, wherein said program further comprises the steps of:

detecting whether jamming occurs, said detecting done by monitoring the status of the operation of transporting the recording medium; and rescheduling the process for each page on the basis of the judgment result given in said judgment step, when jamming is detected in said detection step.

23. A storage medium on which the computer readable program is stored, according to claim 21, wherein said variably setting step includes a step of controlling a feeding speed of each recording medium to said printing mechanism, in accordance with a specified resolution.

24. A storage medium on which the computer readable program is stored, according to claim 21, wherein said resolution is specified via one of said data processing apparatus and a panel provided on said printer.

25. A storing medium which stores a computer readable program for controlling a printer which performs a printing process according to printing information input from a data processing apparatus, said program comprising the steps of:

setting a type of a recording medium to be subjected to a printing operation;

obtaining a time required from a predetermined time until ejecting the recording medium out of the printer, depending on the type of the recording medium set in said setting step;

measuring an elapsed time from the predetermined time; and judging whether a recording medium has been ejected on the basis of the elapsed time measured in said time measurement step and the obtained time obtained in said obtaining step.

26. A storage medium on which the computer readable program is stored, according to claim 25, wherein said program further comprises the steps of:

detecting whether jamming occurs, said detecting done by monitoring the status of the operation of transporting the recording medium; and rescheduling the process for each page on the basis of the judgment result given in said judgment step, when jamming is detected in said detection step.

27. A storage medium on which the computer readable program is stored, according to claim 25, wherein said setting step includes a step of controlling a feeding speed of each recording medium to a printing mechanism, depending on the type of the recording medium being fed.

28. A storage medium on which the computer readable program is stored, according to claim 26, wherein the type of the recording medium is specified via one of a panel provided on said printer and said data processing apparatus.

29. A storage medium on which the computer readable program is stored, according to claim 26, wherein said program further comprises an identifying step for automatically judging the type of the recording medium being passed through a predetermined location.

30. A storage medium on which the computer readable program is stored, according to claim 29, wherein the type of recording medium identified by said identifying step includes at least one of plain paper, OHT paper, recycled paper, thick paper and special paper.

31. A printing system comprising:

a printing mechanism; and a printing control apparatus for controlling said printing mechanism according to printing information input from a data processing apparatus, said printing control apparatus comprising:

variably setting means for variably setting a resolution of said printing mechanism;

obtaining means for obtaining a time required from a predetermined time until ejecting a recording medium out of said printing mechanism, on the basis of the resolution variably set by said variably setting means;

time measurement means for measuring an elapsed time from the predetermined time; and judgment means for judging whether a recording medium has been ejected on the basis of the elapsed time measured by said time measurement means and the obtained time obtained by said obtaining means.

32. A printing system according to claim 31, wherein said printing control apparatus further comprises:

detection means for detecting whether jamming occurs, the detection done by monitoring the status of the operation of the transporting the recording medium; and scheduling means for, when jamming is detected by said detection means, rescheduling the process for each page on the basis of the judgment result given by said judgement means.

33. A printing system according to claim 31, wherein said variably setting means includes means for controlling a feeding speed of each recording medium to said printing mechanism in accordance with a specified resolution.

34. A printing system according to claim 31, wherein said resolution is specified via one of said data processing apparatus and a panel provided on said printing mechanism.

35. A printing system comprising:

a printing mechanism; and a printing control apparatus for controlling said printing mechanism according to printing information input from a data processing apparatus, said printing control apparatus comprising:

setting means for setting a type of a recording medium to be subjected to a printing operation;

obtaining means for obtaining a time required from a predetermined time until ejecting the recording medium out of said printing mechanism, on the basis of the type of the recording medium set by said setting means;

time measurement means for measuring an elapsed time from the predetermined time;

judgment means for judging whether a recording medium has been ejected on the basis of the elapsed time measured by said time measurement means and the obtained time obtained by said obtaining means.

36. A printing system according to claim 35, wherein said printing control apparatus further comprises:

detection means for detecting whether jamming occurs, the detection done by monitoring the status of the operation of transporting the recording medium; and scheduling means for, when jamming is detected by said detection means, rescheduling the process for each page on the basis of the judgment result given by said judgment means.

37. A printing system according to claim 35, wherein said setting means includes means for controlling a feeding speed of each recording medium to said printing mechanism, depending on the type of the recording medium being fed.

38. A printing system according to claim 35, wherein the type of the recording medium is specified via one of a panel provided on said printing mechanism and said data processing apparatus.

39. A printing system according to claim 35, wherein said printing control apparatus further comprises identifying means for automatically identifying the type of the recoding medium being passed through a predetermined location.

40. A printing system according to claim 39, wherein the type of recording medium identified by said identifying means is at least one of plain paper, OHT paper, recycled paper, thick paper, and special paper.

41. A device for outputting image information to a printer comprising:

instructing means for instructing one of a plurality of modes, said plurality of modes being different, in a feeding speed of a recording medium;

timer means for performing a time measuring operation for each recording medium;

recognizing means for recognizing whether a jam occurs in a printer; and judgment means for judging which page image information is output for recovering;

wherein in cases where one measured time is less than a predetermined time corresponding to the instructed mode, said judgment means judges that the page of image information to be recorded on a recording medium, to which said one measured time corresponds, is to be output for recovering.

42. A device according to claim 41, wherein in each of the plurality of modes, an image having different resolution is printed.

43. A device according to claim 41, wherein in each of the plurality of modes, an image is printed on a different type of a recording medium.

44. A device according to claim 41, wherein said instructing means instructs one of the plurality of modes to the printer in accordance with a command from at least one of an external apparatus and an operation on an operation panel.

45. A device according to claim 41, wherein said device outputs image information to an electrical photographic printer.

46. A method for outputting image information to a printer comprising the steps of:

instructing one of a plurality of modes, said plurality of modes being different, in a feeding speed of a recording medium;

performing a time measuring operation for each recording medium;

recognizing whether a jam occurs in a printer; and judging which page image information is output for recovering;

wherein in cases where one measured time is less than a predetermined time corresponding to the instructed mode, said judging step judges that the page of the image information to be recorded on a recording medium, to which said one measured time corresponds, is to be output for recovering.

47. A method according to claim 46, wherein in each of the plurality of modes, an image having different resolution is printed.

48. A method according to claim 46, wherein in each of the plurality of modes, an image is printed on a different type of a recording medium.

49. A method according to claim 46, wherein said instructing step instructs one of the plurality of modes to the printer in accordance with a command from at least one of an external apparatus and an operation on an operation panel.

50. A method according to claim 46, wherein said device outputs image information to an electrical photographic printer.

51. A system comprising a printer and a device for outputting image information to the printer, said outputting device comprising:

instructing means for instructing one of a plurality of different modes in a feeding speed of a recording medium;

timer means for performing a time measuring operation for each recording medium;

recognizing means for recognizing whether a jam occurs in the printer; and judgment means for judging which page of image information is to be output for recovering;

wherein in cases where one measured time is less than a predetermined time corresponding to the instructed mode, said judgment means judges that the page of image information to be recorded on a recording medium, to which said one measured time corresponds, is to be output for recovering, and said printer comprising:

control means for operating the printer in the mode instructed by said instructing means;

detecting means for detecting a jam; and information means for informing the outputting device of the jam detected by said detecting means.

52. A system apparatus according to claim 51, wherein in each of the plurality of modes, an image having different resolution is printed.

53. A system apparatus according to claim 51, wherein in each of the plurality of modes, an image is printed on a different type of a recording medium.

54. A system apparatus according to claim 51, wherein said instructing means instructs one of the plurality of modes to the printer in accordance with a command from at least one of an external apparatus and an operation on an operation panel.

55. A system apparatus according to claim 51, wherein the printer is an electrical photographic printer.

* * * * *

UNITED STATES PATENT AND TRADEMARK OFFICE

CERTIFICATE OF CORRECTION

PATENT NO. : 6,099,181

DATED : August 8, 2000

INVENTOR(S): HIRONOBU KITABATAKE

It is certified that error appears in the above-identified patent and that said Letters Patent is hereby corrected as shown below:

SHEET NO. 15:
Figure 23, "INF" should read --IN--.

COLUMN 3:
Line 38, "Ti" should read --T1--.

COLUMN 7:
Line 6, "charts" should read --chart--; and
Line 13, "slog" should read --slot--.

COLUMN 8:
Line 58, "determined" should read --determine--.

COLUMN 10:
Line 33, "are" should read --is--.

COLUMN 11:
Line 52, "step." should read --step--.

COLUMN 12:
Line 41, "thick paper," should be deleted.

COLUMN 15:
Line 2, "perform" should read --performs--.

COLUMN 16:
Line 55, "are" should read --is--.

UNITED STATES PATENT AND TRADEMARK OFFICE

CERTIFICATE OF CORRECTION

PATENT NO. : 6,099,181

DATED : August 8, 2000

INVENTOR(S): HIRONOBU KITABATAKE

It is certified that error appears in the above-identified patent and that said Letters Patent is hereby corrected as shown below:

COLUMN 17:
Line 9, "are" should read --is--.

COLUMN 18:
Line 55, "specified or manually" should read --or manually specified--.

COLUMN 19:
Line 47, "is" should be deleted; and
Line 60, "of" should read --of the--.

COLUMN 20:
Line 64, "is" should read --are--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*